US007765935B2

(12) United States Patent
Bounds

(10) Patent No.: US 7,765,935 B2
(45) Date of Patent: Aug. 3, 2010

(54) RAIL THREADING MECHANISM

(75) Inventor: Ivan E. Bounds, St. Joseph, MO (US)

(73) Assignee: Herzog Contracting Corp., St. Joseph, MO (US)

( * ) Notice: Subject to any disclaimer, the term of this patent is extended or adjusted under 35 U.S.C. 154(b) by 0 days.

(21) Appl. No.: 12/334,733

(22) Filed: Dec. 15, 2008

(65) Prior Publication Data

US 2009/0095188 A1 Apr. 16, 2009

Related U.S. Application Data

(62) Division of application No. 11/613,043, filed on Dec. 19, 2006, now Pat. No. 7,707,943.

(51) Int. Cl.
*E01B 29/05* (2006.01)

(52) U.S. Cl. ..... 104/2

(58) Field of Classification Search ..... 104/4, 104/5, 7.1, 7.2; 37/104
See application file for complete search history.

(56) References Cited

U.S. PATENT DOCUMENTS 7,350,467 B2 4/2008 Green et al.

*Primary Examiner*—S. Joseph Morano
*Assistant Examiner*—Robert J McCarry, Jr.
(74) *Attorney, Agent, or Firm*—Erickson, Kernell, Derusseau & Kleypas, LLC.

(57) ABSTRACT

A rail threading mechanism for a rail handling vehicle includes a thread box mounted on the outer end of a manipulating arm. The thread box includes a platform and a pair of jaws pivotally connected to the platform and moveable between open and closed positions. The platform includes a support roller for rollingly engaging the flat bottom of a rail. Each jaw include a plurality of jaw rollers positioned for rollingly engaging a rail positioned on the support roller when the respective jaw is in the closed position. The jaw rollers on each jaw preferably include a pair of base rollers positioned for engaging an edge of the base of the rail, a pair of flange top rollers positioned for engaging a top surface of the top flange of the rail, and a flange side roller positioned for engaging an edge surface of the top flange of the rail.

30 Claims, 17 Drawing Sheets

RAIL THREADING MECHANISM

CROSS-REFERENCE TO RELATED APPLICATIONS

This application is a division of application Ser. No. 11/613,043 filed Dec. 19, 2006.

FIELD OF THE INVENTION

This invention relates in general to railway maintenance equipment and deals more particularly with rail unloading apparatus used to unload lengthy ribbon rails along railway lines.

BACKGROUND OF THE INVENTION

The laying of railway track, either in the initial construction of a railway line or when replacing existing rails, is necessarily a difficult, time consuming and labor intensive job. Standard industry practice involves constructing individual rail sections and the welding them together end to end to form lengthy ribbon rails that may be as long as 1800 feet or more.

The ribbon rails have traditionally been transported to their installation site by transporting them along the railway and loading them onto special rail cars equipped with bunks that receive the rails on several different tiers. The rails are unloaded from the special car side-by-side in pairs using equipment that conventionally includes a complicated winch, thread box and pulley system. The rails are unloaded form the special car using this complicated equipment in a time consuming process that involves repeated starts and stops of the locomotive that pulls the special rail unloading car along the track, and manual handling of the rails and equipment.

This conventional practice is problematic in several respects. It requires significant manual labor to handle the equipment and connect it with the rails, and workers are subjected to the risk of serious injury because they must physically be present at the site of the operations that are carried out. The time required to unload the rails in this manner adds significantly to both the labor costs and to the overall maintenance costs of the railway.

Although equipment has been proposed to attempt to automate the process more fully and reduce the need for extensive manual labor and the risk of personal injury, such equipment has not been wholly satisfactory. For example, U.S. Pat. Nos. 5,227,435 and 6,981,452 to Theurer, et al. disclose complicated rail unloading machines that include complexities such as cable and pulley systems, specially constructed crawlers, and conveyor systems of various types. Aside from the cost and maintenance problems resulting from the need for such complicated machinery, the Theurer equipment operates only on railway track. Consequently, when the rails need to be transported over lengthy distances, they are restricted to rail transportation and cannot be transported over-the-road along highways or other roadways that may be a more efficient mode of transportation.

More recently, a rail unloading machine has been developed for travel interchangeably along a railway or a roadway, as disclosed in U.S. Pat. No. 6,981,452 to Herzog, et al. Although this Herzog machine is a substantial improvement because of the versatility it offers with respect to modes of transportation, it is not self-propelled but instead requires one type of vehicle to transport it on a roadway and another vehicle such as a locomotive to transport it along a railway. Accordingly, there is a need to couple and uncouple the rail unloading equipment from the different towing vehicles required for the different modes of travel, and this adds to the time, cost and complexity of the entire operation.

Additionally, it is desirable for a pair of rails to be unloaded simultaneously on opposite sides of the rail bed outwardly of the rails and rail ties that are already in place. To accomplish this, the thread boxes must be spaced apart far enough to enable the rails to be unloaded outwardly of the rails and the ends of the ties that are installed on the rail bed, and this can result in equipment that is too wide to travel safely on many roadways.

SUMMARY OF THE INVENTION

The present invention is directed to a rail unloading machine that is improved in many different respects over equipment that has been available in the past.

The invention is characterized in one respect by a rail unloading machine that is self-contained and self-propelled such that a single self-propelled vehicle provides the motive power to transport the machine both along a roadway and along a railway.

The invention is characterized in another respect by the provision of threading mechanisms which unload the rails and which may be extended sidewardly for operation to unload rails on a rail bed and also may be retracted for storage in a narrow profile position to minimize the width of the machine for transport along a roadway without exceeding highway width regulations. In addition to swinging in and out, another aspect of the invention is that the threading mechanisms may be pivoted up and down for more secure storage in the transport position.

Another aspect that characterizes the invention is a thread box construction in which opposing jaws are provided to accommodate easy receipt of the rails when the jaws are open, and to assure secure and accurate positioning of the rails within the thread box roller system to allow effective and reliable unloading of the rails when the jaws are closed. This construction has the advantage of not requiring precise application of the rails to the thread boxes as is required in the case of closed thread boxes.

The invention is characterized by the additional feature of a rail clamp that is uniquely constructed to accommodate effective application of the rails to the threading mechanisms. In this regard, the rail clamp is equipped with one and preferably two dog elements that can be clamped rigidly to the rails to enable the clamp to effectively feed the rails to the threading mechanisms. It is preferred for two dogs to be included, pivoting in opposite directions to clamp against the rail, because this has the advantage of enabling the rails to be manipulated back and forth without slippage, as is sometimes necessary when the rails are being applied to the thread boxes.

Still another aspect of the invention involves the provision of a rail saw that is characterized by a variety of novel features each representing an improvement independently of the others. Among the features exhibited by the saw are a secure clamping system for holding the rail in place relative to the saw blade; a leveling system for assuring a cut precisely perpendicular to the rail axis; assurance that a cut is initiated only when the saw blade has reached the design rotational speed; automatic reduction in the rate of feeding of the blade through the rail if the blade rotational speed is too slow, or if the back pressure of the hydraulic blade rotation motor is too high, or if the electric motor used to feed the blade draws current at an excessive level; and automatic initiation of a back feeding stroke of the saw through the cut after the cut has been completed, with the saw blade continuing to rotate during the back feeding stroke and the blade feed and rotation motors being deactivated automatically when the end of the back feeding stroke is reached.

From an overall standpoint, the invention is characterized by all of the foregoing advantages and benefits, as well as added advantages and benefits including reduction in labor requirements, enhanced safety due to the automated nature of the operations allowing personnel to remain remote from the site of potentially dangerous operations, and more efficient and reliable rail unloading, all accomplished at less cost and more expediently than has been possible in the past.

DETAILED DESCRIPTION OF THE PREFERRED EMBODIMENT

Figure 1:
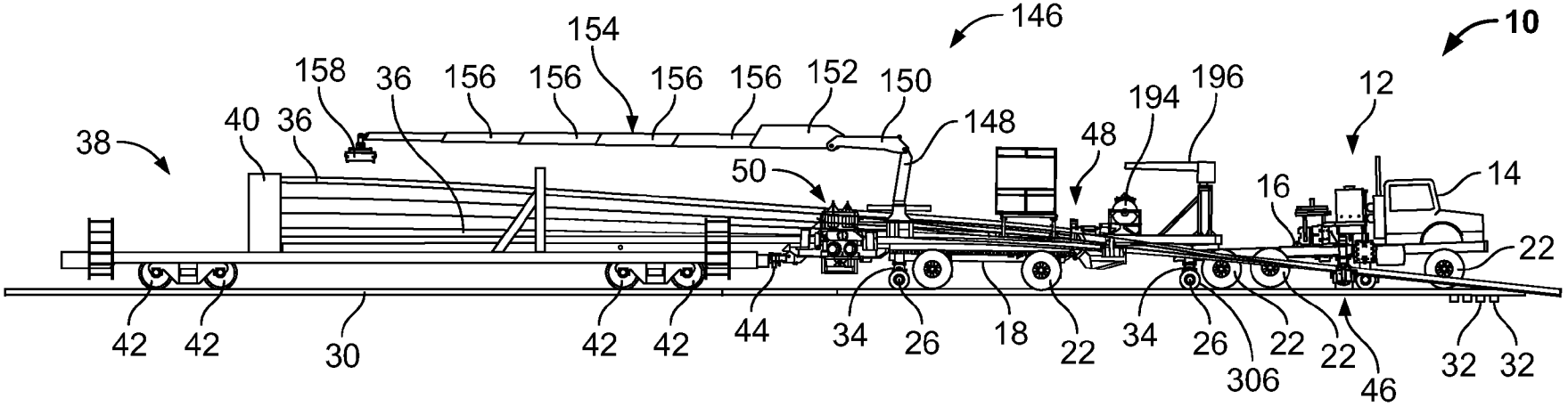
FIG. 1 is a side elevational view of a rail unloading machine constructed according to a preferred embodiment of the present invention coupled to a rail carrying car, with the threading mechanisms extended in their operating positions to unload a rail.
Figure 2:
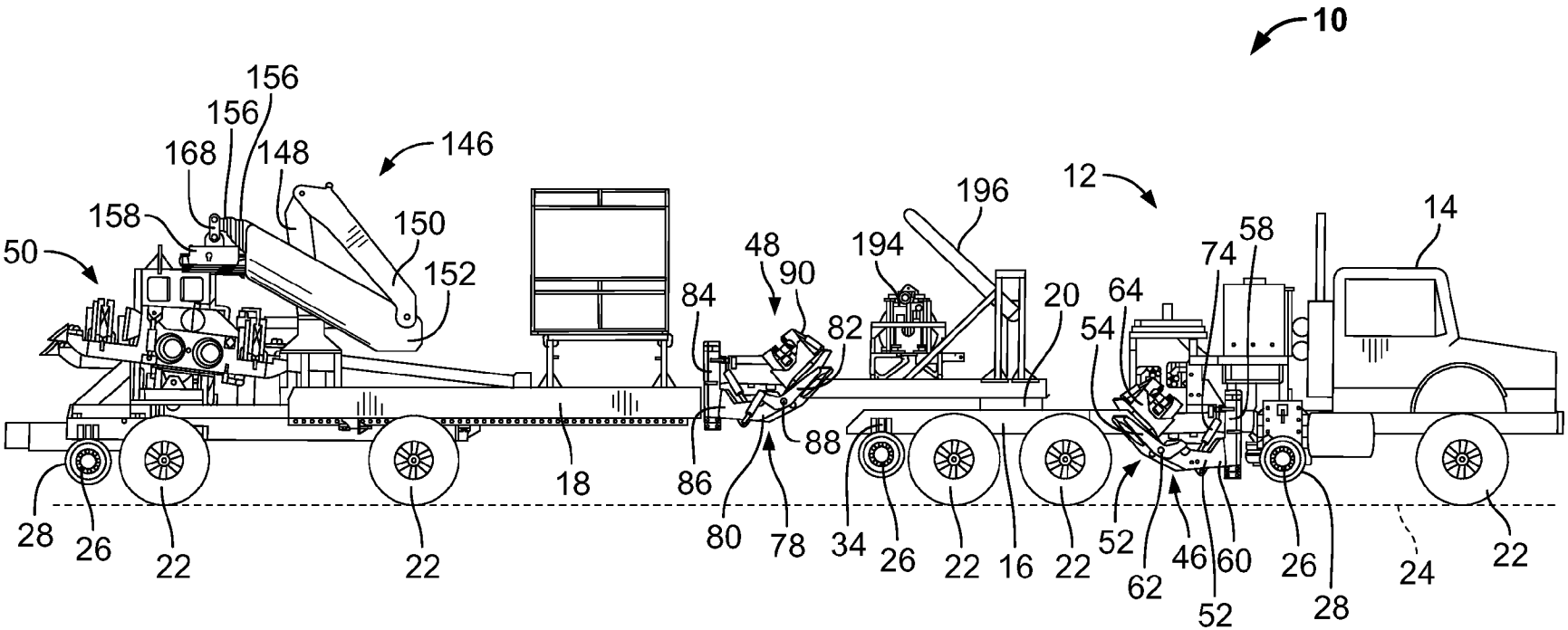
FIG. 2 is a side elevational view showing the rail unloading machine of FIG. 1 decoupled from the rail carrying car and traveling along a roadway with the threading mechanisms retracted for transport and the flanged rail wheels retracted to accommodate over the road travel.

Referring now to the drawings in more detail and initially to FIGS. 1 and 2, numeral 10 generally designates a rail unloading machine constructed in accordance with a preferred embodiment of the present invention. The machine 10 includes a self-propelled vehicle 12 having an operator's cab 14 mounted on a rigid frame 16. The vehicle 12 is equipped with a conventional engine for propelling the vehicle, such as a gasoline or diesel engine. The vehicle 12 may be generally in the nature of a conventional tractor such as that commonly included in over the road tractor-trailers. A rear frame 18 is coupled to frame 16 by means of a conventional swivel coupling 20 (FIG. 2).

The frames 16 and 18 are each equipped with a plurality of conventional wheels and tires 22 of the type used on tractor-trailers for over-the-road travel along a roadway such as the roadway 24 shown in FIG. 2. Each frame 16 and 18 is also equipped with a plurality of flanged rail wheels 26 having flanges 28 on their inside edges. The rail wheels 26 may be of the type commonly used on rail cars so that the wheels 26 can travel along the rails of a railway such as the rails 30 (FIG. 1) mounted on ties 32 which are installed on the railway bed.

The rail wheels 26 are mounted to the frames 16 and 18 for up and down movement on hydraulic cylinders 34. When the cylinders 34 are fully retracted, the wheels 26 are raised above the lowermost points of the tires 22, enabling the tires to engage and roll along the roadway 24 in the over-the-road mode of the machine 10. The cylinders 34 may be extended as shown in FIG. 1 in order to lower the flanged wheels 26 onto the rails 30 such that the frames 16 and 18 are raised sufficiently that the tires 22 are above the railway bed and the entire weight of the machine 10 is borne by the railway wheels 26. The wheels 26 are spaced apart in pairs on opposite sides of the frames 16 and 18 at the standard spacing between the two rails of a standard railway line.

The machine 10 is used for the unloading of lengthy ribbon rails such as the rails 36 shown in FIG. 1. The rails 36 may be of the type referred to in the industry as "ribbon rails", and they may be as long as 1800 feet or more, constructed by welding standard rail lengths end to end. The rails 36 may be carried on a special rail carrying car 38 (or a number of cars 38 arranged end-to-end) equipped with conventional bunks 40 which carry the rails 36 side-by-side in separate tiers (typically, 8-10 rails per tier, although other numbers are possible). The rail carrying car 38 includes rail wheels 42 enabling it to travel along the rails 30. The front end of the rail carrying car 38 may be detachably coupled to the rear end of the machine 10 as indicated at 44 in FIG. 1.

The machine 10 is used to unload the rails 36 from car 38. To accomplish unloading of the rails, the machine 10 is equipped with a pair of front threading mechanisms which are generally identified by numeral 46 in FIGS. 1 and 2. The front threading mechanisms 46 are located a short distance behind the operator's cab 14 and are spaced apart on opposite sides of the frame 16. A pair of center threading mechanisms generally identified by numeral 48 are provided on opposite sides of the rear frame 18 and are spaced apart on opposite sides of the rear frame at an intermediate location. The machine also includes a pair of rear threading mechanisms 50 mounted on opposite sides of the frame 18 near its back end.

As best shown in FIG. 2, each of the front threading mechanisms 46 has an arm assembly 52 which includes an inner arm 54 and an outer arm 56. The inner arm 54 is pinned at its inner end portion to the lower end portion of a vertical column 58 mounted to the frame 16 such that arm 54 can pivot up and down on column 58 about a horizontal axis 60. The outer arm 56 is pinned near its inner end to the outer end portion of arm 54 so that arm 56 can pivot up and down relative to arm 54 about a horizontal pivot axis 62. A thread box 64 of threading mechanism 46 is carried on the outer arm 56 of each arm assembly 52.

Figure 3:
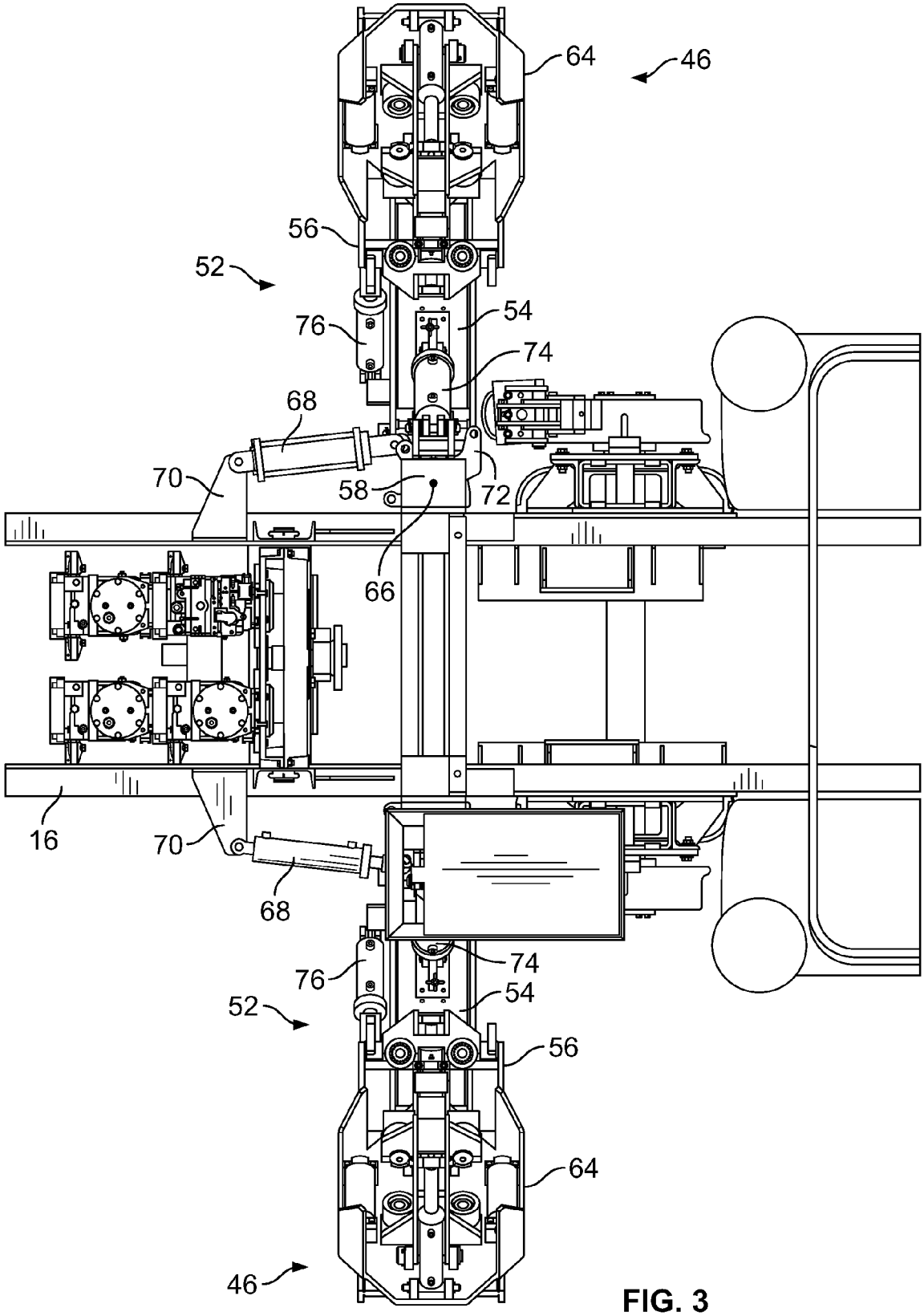
FIG. 3 is a fragmentary top plan view of the front rail threading mechanisms of the machine shown in FIGS. 1 and 2, with the threading mechanisms in their extended operating positions.

With additional reference to FIG. 3 in particular, each arm assembly 52 is mounted to turn on column 58 about a vertical axis 66. A hydraulic cylinder 68 is pinned at its base end to an ear 70 secured to frame 16 and at its rod end to a lug 72 projecting from the inner end of the arm assembly 52. Extension of cylinder 68 pivots the arm assembly 52 about axis 66 to the fully extended position shown in FIG. 3, wherein the arm assembly extends fully to the side from frame 16. Retraction of cylinder 68 turns arm assembly 52 about axis 66 in a manner to fully retract the arm assembly to the position shown in FIG. 2, wherein the arm assembly extends generally alongside the frame 16 in a much narrower profile than in the extended position.

Each of the inner arms 54 is pivoted up and down about pivot axis 60 by a hydraulic cylinder 74. Another hydraulic cylinder 76 (FIG. 3) serves to pivot each outer arm 56 up and down about pivot axis 62. Allowing the arms 54 and 56 of each arm assembly 52 to be folded upwardly in this manner allows the thread boxes 64 and the entirety of each threading mechanism 46 to be raised well above the roadway 24 when the machine 10 is in the transport mode for travel along the roadway 24.

With continued reference to FIG. 2 in particular, each of the center threading mechanisms 48 includes an arm assembly 78 that has an inner arm 80 and an outer arm 82. The inner arm 80 is pivoted at its inner end to an upright column 84 secured to the rear frame 18 at an intermediate location along its front to back dimension. Arm 80 is pinned to column 84 to pivot up and down about a horizontal pivot axis 86. The outer arm 82 is pivoted at its inner end to the outer end portion of arm 80 for pivotal movement about a horizontal pivot axis 88. Each outer arm 82 carries a thread box 90.

Figure 4:
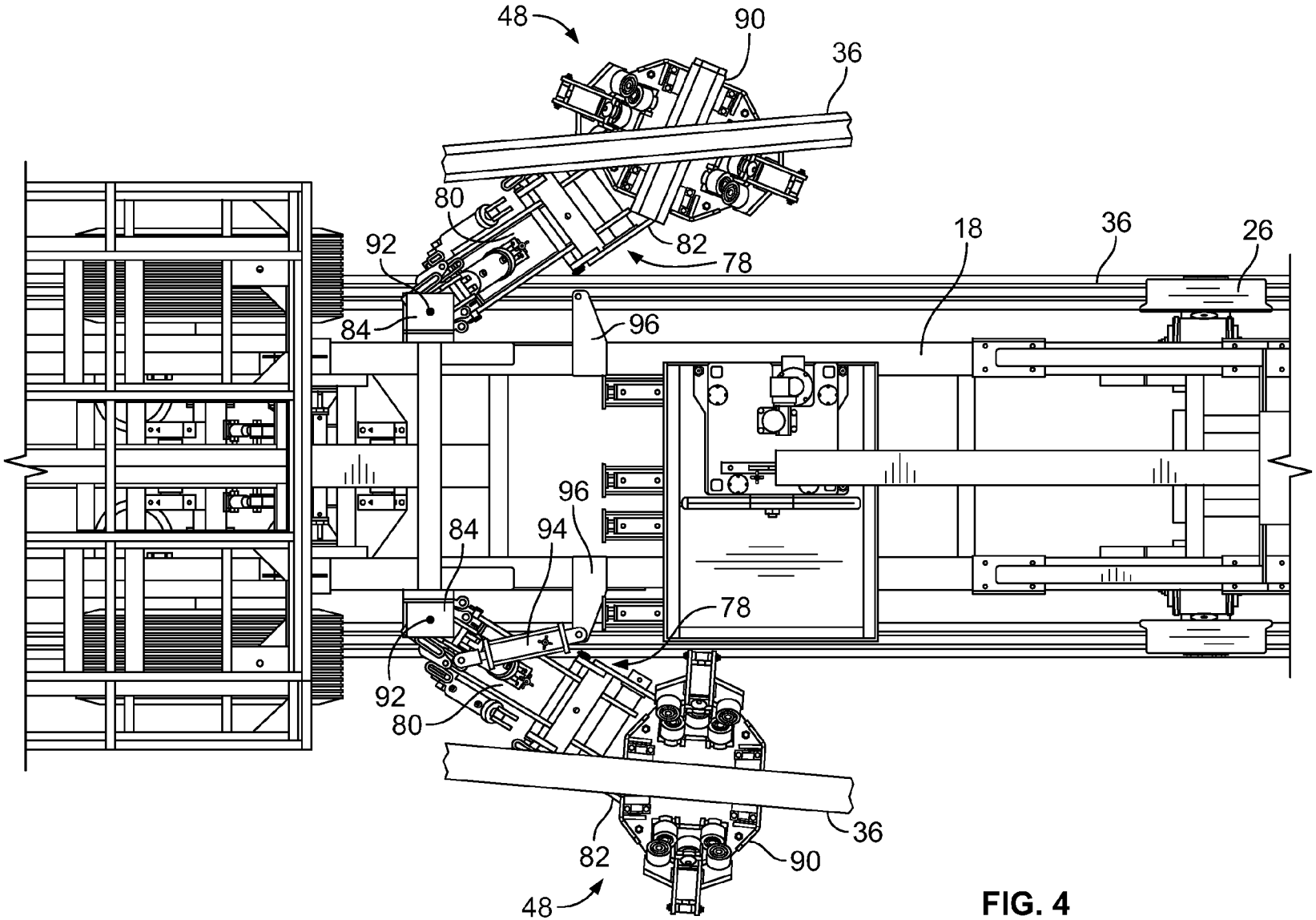
FIG. 4 is a fragmentary top plan view of the center rail threading mechanisms of the machine shown in FIGS. 1 and 2, with the threading mechanisms extended for the unloading of rails.
Figure 5:
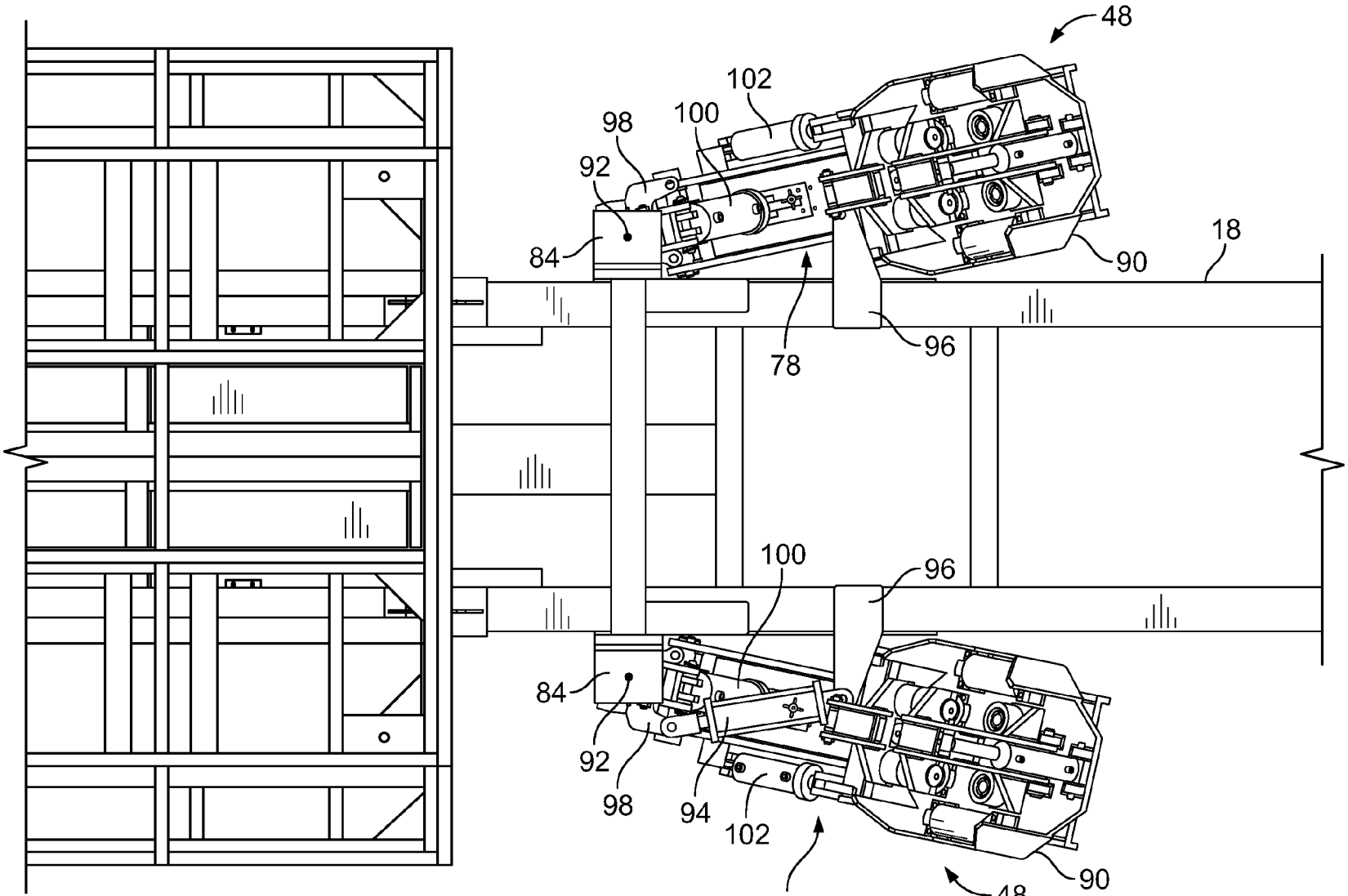
FIG. 5 is a top plan view similar to FIG. 4, but showing the center threading mechanisms in their retracted storage positions for transport.

With additional reference to FIGS. 4 and 5, the inner end of each arm assembly 78 is mounted to turn on the corresponding column 84 about a vertical axis 92. A cylinder 94 is pinned at its base end to an ear 96 on frame 18 and at its rod end to a lug 98 extending from the inner arm 80. When cylinders 94 are extended, the arm assemblies 78 are extended to the position shown in FIG. 4 wherein they extend outwardly at an angle from the frame 18 for operation to unload rails. When the cylinders 94 are retracted, the arm assemblies 78 are turned inwardly about the axes 92 to extend generally along the frame 18 in the retracted transport position of FIG. 5 wherein the arm assemblies present a narrower profile than in the extended position of FIG. 4.

With continued reference to FIGS. 4 and 5 in particular, the inner arms 80 are pivoted up and down about the pivot axes 86 by hydraulic cylinders 100. Additional hydraulic cylinders 102 are used to pivot the outer arms 82 up and down relative to the inner arms 80 about the pivot axes 88.

Figure 6:
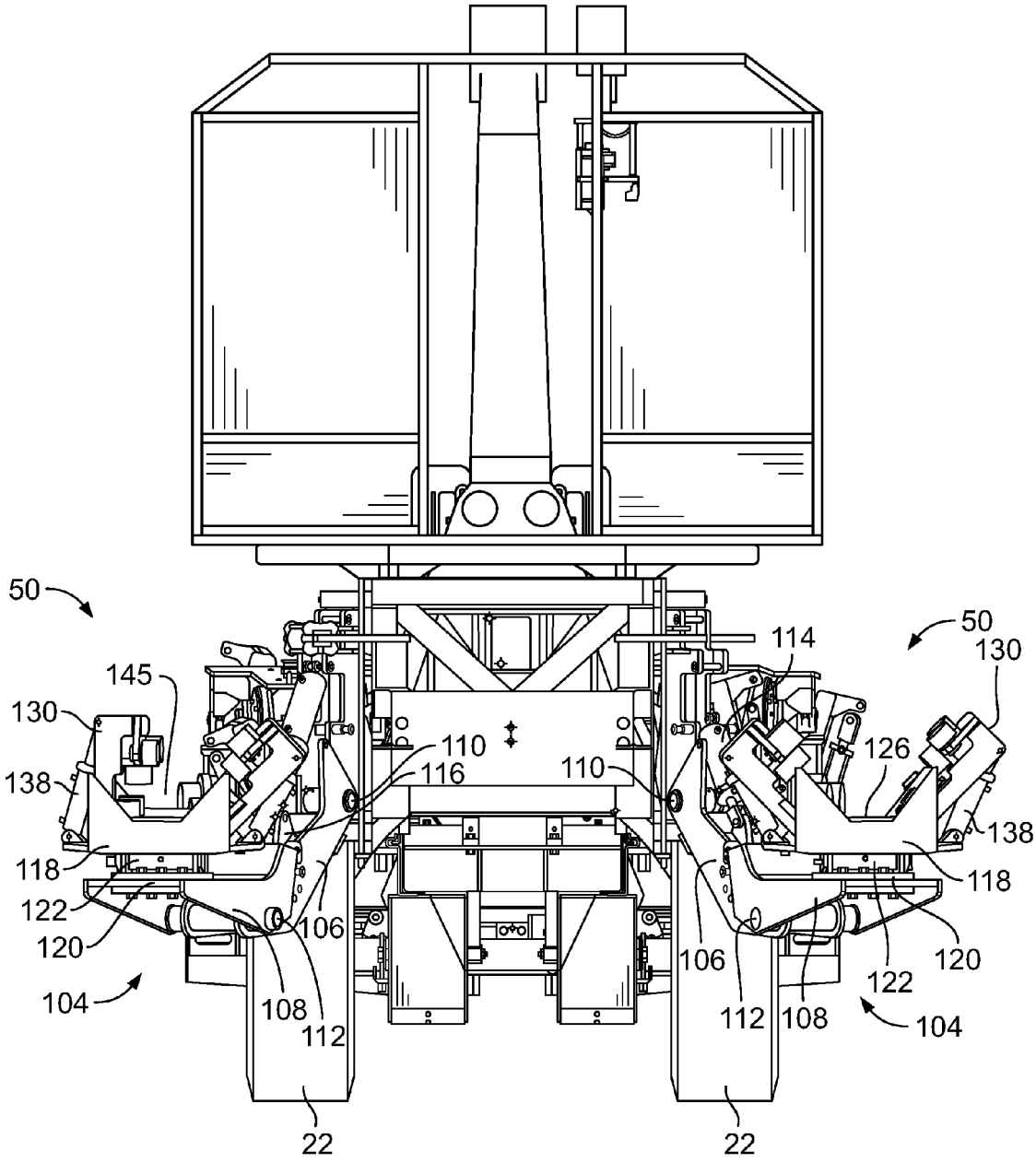
FIG. 6 is a fragmentary rear elevational view of the machine shown in FIGS. 1 and 2, with the thread box jaws of one of the rear threading mechanisms fully open and the jaws of the other rear threading mechanism partially open.

With particular reference now to FIG. 6, each of the rear threading mechanisms 50 includes an arm assembly 104 having an inner arm 106 and an outer arm 108. Each of the inner arms 106 is pivoted to the rear end portion of frame 18 for up and down pivotal movement about a horizontal axis 110. Each of the outer arms 108 is pivotally connected with the outer end portion of inner arm 106 for up and down pivotal movement relative to arm 106 about a horizontal pivot axis 112. A hydraulic cylinder 114 extends and retracts to pivot inner arm 106 up and down about axis 110. An additional hydraulic cylinder 116 extends and retracts to pivot the outer arm 108 up and down relative to arm 106 about axis 112. Thread boxes 118 are carried on the outer arms 108. The arm assemblies 104 of the rear threading mechanisms 50 may be folded by cylinders 114 and 116 between the lowered operating position shown in FIG. 1 and the raised transport position shown in FIG. 2.

The front thread boxes 64, center thread boxes 90 and rear thread boxes 118 are mounted on the respective arm assemblies 52, 78 and 104 in substantially the same manner. Exemplary are the rear thread boxes 118 which are mounted on the outer arms 108 on turntables 120 (FIG. 6) allowing the thread boxes 118 to rotate about axes generally perpendicular to axes 112. Each thread box 118 is mounted on the turntable 120 for movement about a pivot axis 122 which is perpendicular to the rotational axis of the turntable 120.

Figure 7:
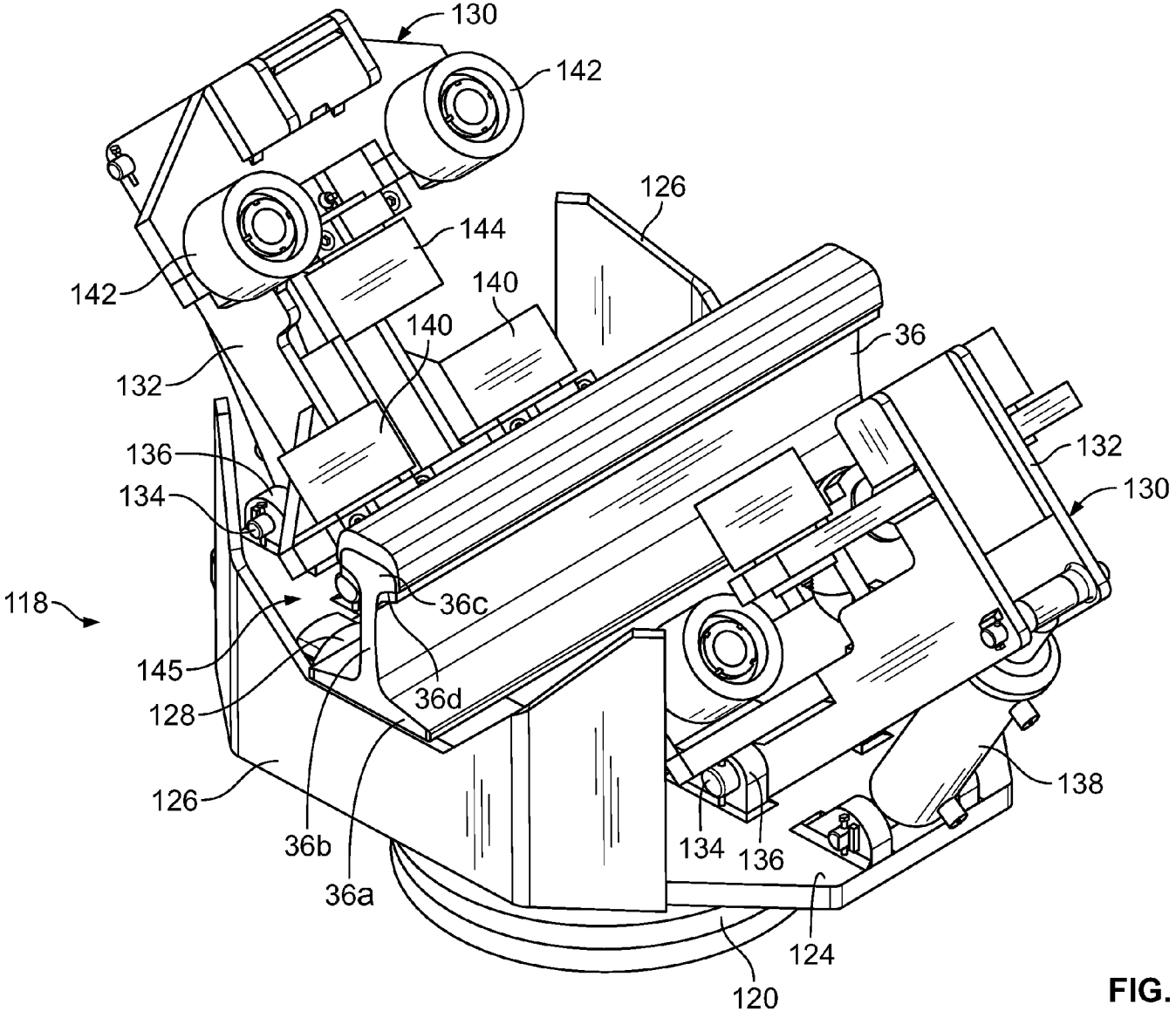
FIG. 7 is a perspective view of an exemplary thread box of one of the thread box mechanisms of the machine shown in FIGS. 1 and 2, with the jaws of the thread box open and a rail applied to the thread box between the open jaws.
Figure 8:
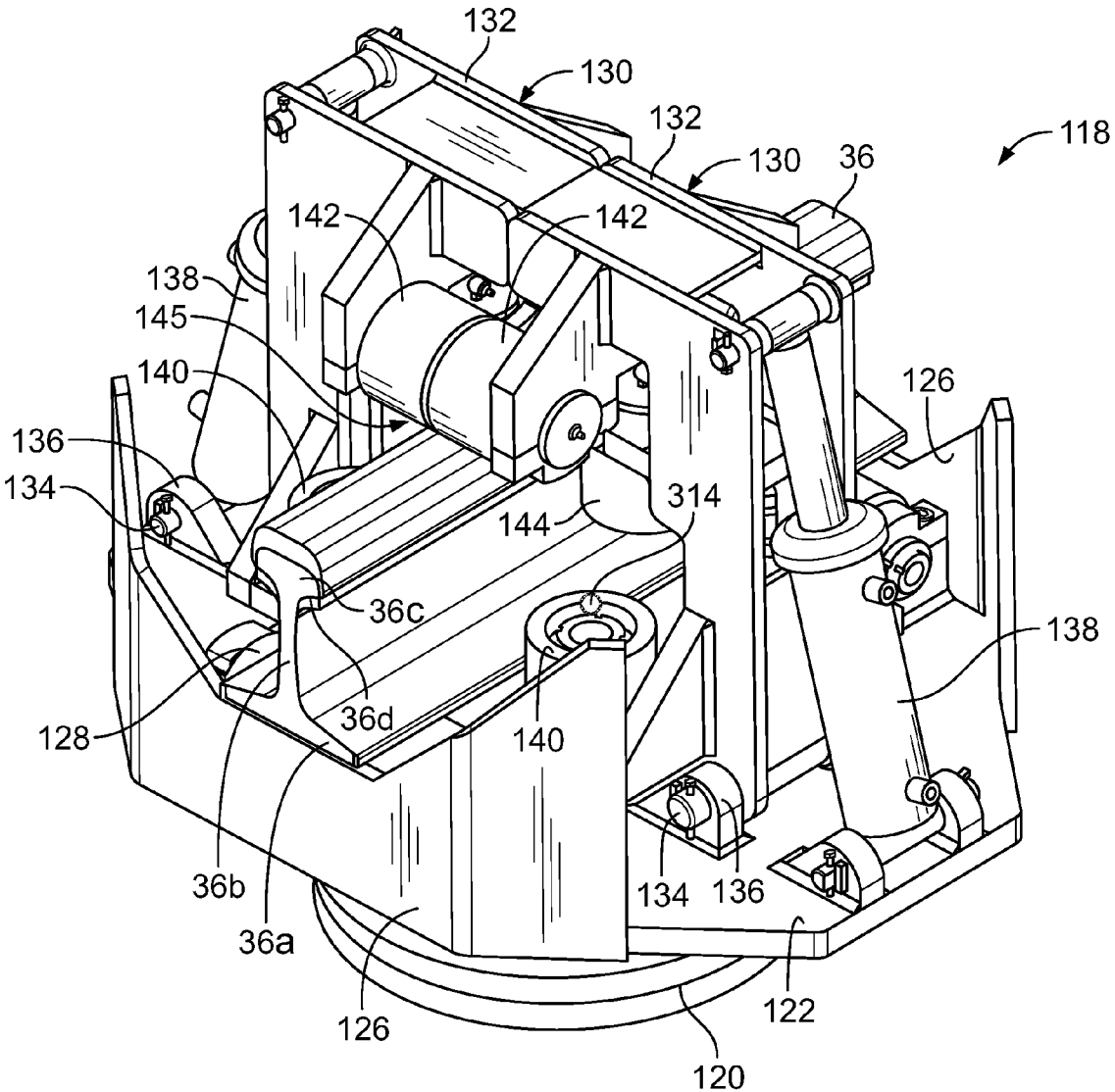
FIG. 8 is a perspective view similar to FIG. 7, but showing the jaws of the thread box closed to apply the rollers of the thread box roller system to the rail.

The thread boxes 64, 90 and 118 are all constructed in substantially the same manner which is best illustrated in FIGS. 7 and 8 depicting one of the rear thread boxes 118. The thread box 118 includes a generally flat platform 124 which is mounted on top of the turntable 120. Upstanding walls 126 are provided on opposing edges of the platform 124. A pair of support rollers 128 are mounted for rotation on the platform 124 adjacent to the walls 126 at locations to receive rails 36 applied to the thread box. Each rail 36 includes a base **36*a* having a flat bottom which is received on the rollers 128. A vertical web 36*b* extends upwardly from the center of the rail base 36*a*. The top of the rail is formed by a bead or flange 36*c* at the upper end of the web 36*b*. The flange 36*c* presents inclined surfaces 36*d*** on its underside.

Each of the thread boxes includes a pair of jaws 130 which oppose one another and can be moved between the open position shown in FIG. 7 and the closed position shown in FIG. 8. The jaws 130 have rigid frames 132 which are mounted on horizontal shafts 134 at their lower ends. The shafts 134 are in turn mounted to pivot in bearings 136 secured to the platform 124. Each of the jaws 130 is equipped with a hydraulic cylinder 138 which is pivoted at its lower base end to the platform 124 and at its upper or rod end to the upper portion of the jaw frame 132. When the cylinders 138 are retracted as shown in FIG. 7, the jaws 130 are pivoted about the axes of shafts 134 to their open position for receiving a rail 36. Conversely, extension of the cylinders 138 pivots the jaws 130 to the closed position shown in FIG. 8.

Each of the jaws 130 is provided with a pair of base rollers 140 which are mounted to rotate on the jaw frames 130. The rollers 140 in each pair are spaced apart and are located to fit against the opposite edges of the rail base **36*a* when the jaws are closed. Each jaw 130 has an additional pair of rollers 142 which serve as flange top rollers that are applied against the top of the rail flange 36*c* in the closed position of the jaws 130 (FIG. 8). The rollers 142 in each pair are mounted for rotation on the jaw frame 130 at spaced apart locations. When the jaws are closed, rollers 142 are adjacent to one another and the rotational axes of the opposing pairs of flange top rollers 142** are aligned with one another.

Each jaw 130 has a flange side roller 144 which is mounted on the jaw frame 132 for rotation at a location to engage the side edge of the rail top flange **36*c*** when the jaws are closed.

The rollers 144 on the opposing jaws 130 oppose one another and engage the opposite side edges of the top flange 36*c* in the closed position of the jaws. The thread box 118 provides a passage 145 which is bounded by rollers 128 at the bottom and, when the jaws 130 are closed by rollers 140 and 144 on the sides and rollers 142 at the top. The passage 145 is exposed at the top to accommodate receipt of a rail 36 when the jaws 130 are open, and the passage is closed upon closure of the jaws.

One or more of the rollers 128, 140, 142 or 144 may be a driven roller used to feed the rails 36 through the thread boxes 64, 90 and 118. The drive system used to rotate the driven roller or rollers may be electric or hydraulic, or it may be another type of power system.

The rails 36 may be applied to the thread boxes 64, 90 and 118 through the use of a crane which is generally identified by numeral 146 in FIGS. 1 and 2. The crane 146 includes an upright column 148 which is mounted on the bed of frame 18 near its back end for rotation about the vertical axis of the column 148. An arm 150 is pivoted at one end to the top end of the column 128 and at the other end to the base section 152 of an elongated boom 154. The boom 154 includes a plurality of telescoping boom sections 156 which fit telescopically in one another and which may be retracted into the base boom section 152 (see FIG. 2). The parts of the crane 146 may be controlled hydraulically with respect to rotational and pivotal movement and telescopic extension and retraction of the boom 154. The outer end of the boom 154 carries a rail clamp which is generally identified by numeral 158 and which may be clamped onto the rails 36 to apply the rails to the threading mechanisms in cooperation with the operation of the crane 146.

Figure 9:
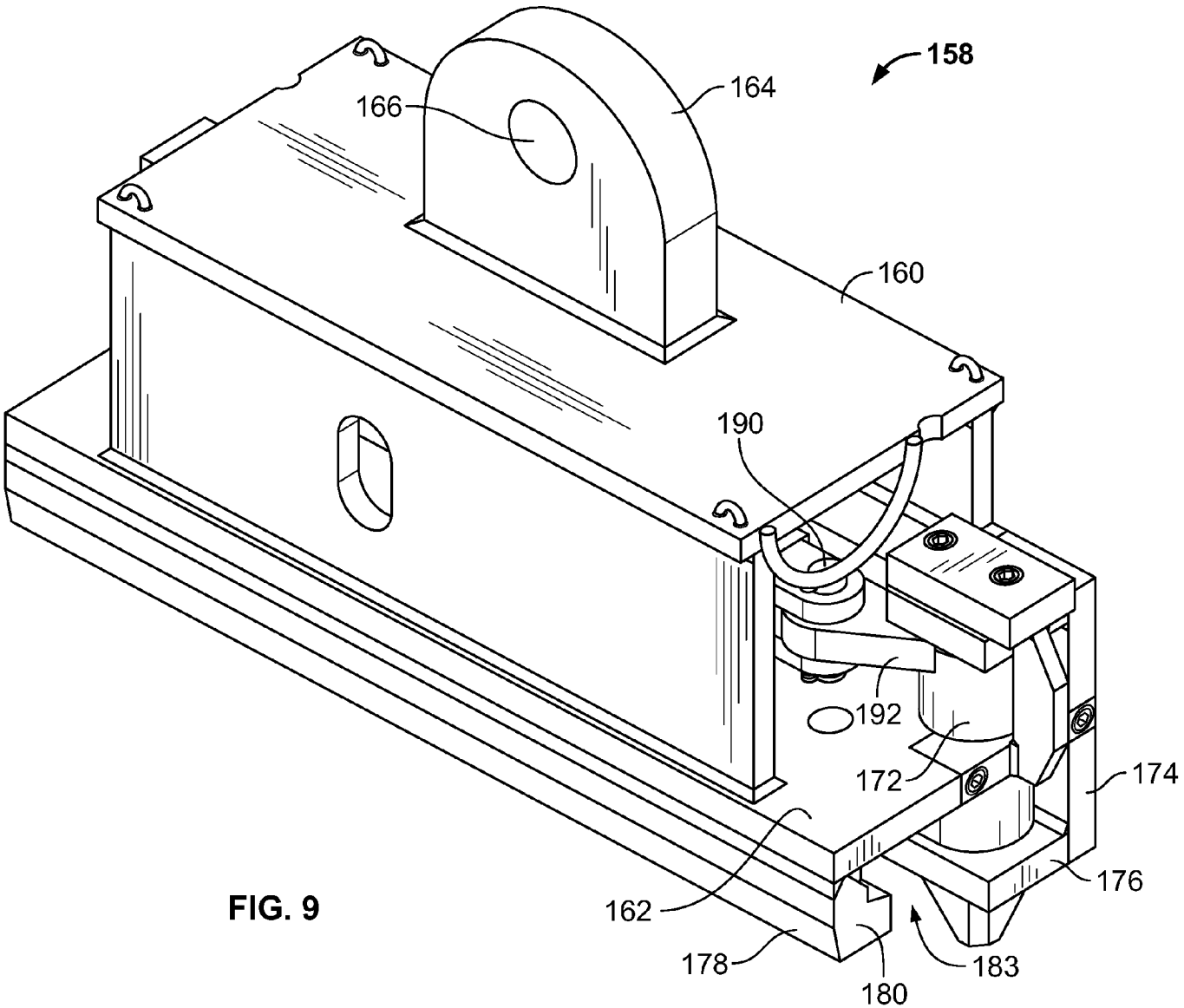
FIG. 9 is a fragmentary perspective view on an enlarged scale of the rail clamp device of the machine shown in FIGS. 1 and 2, with the dog elements of the rail clamp device in their retracted positions.
Figure 10:
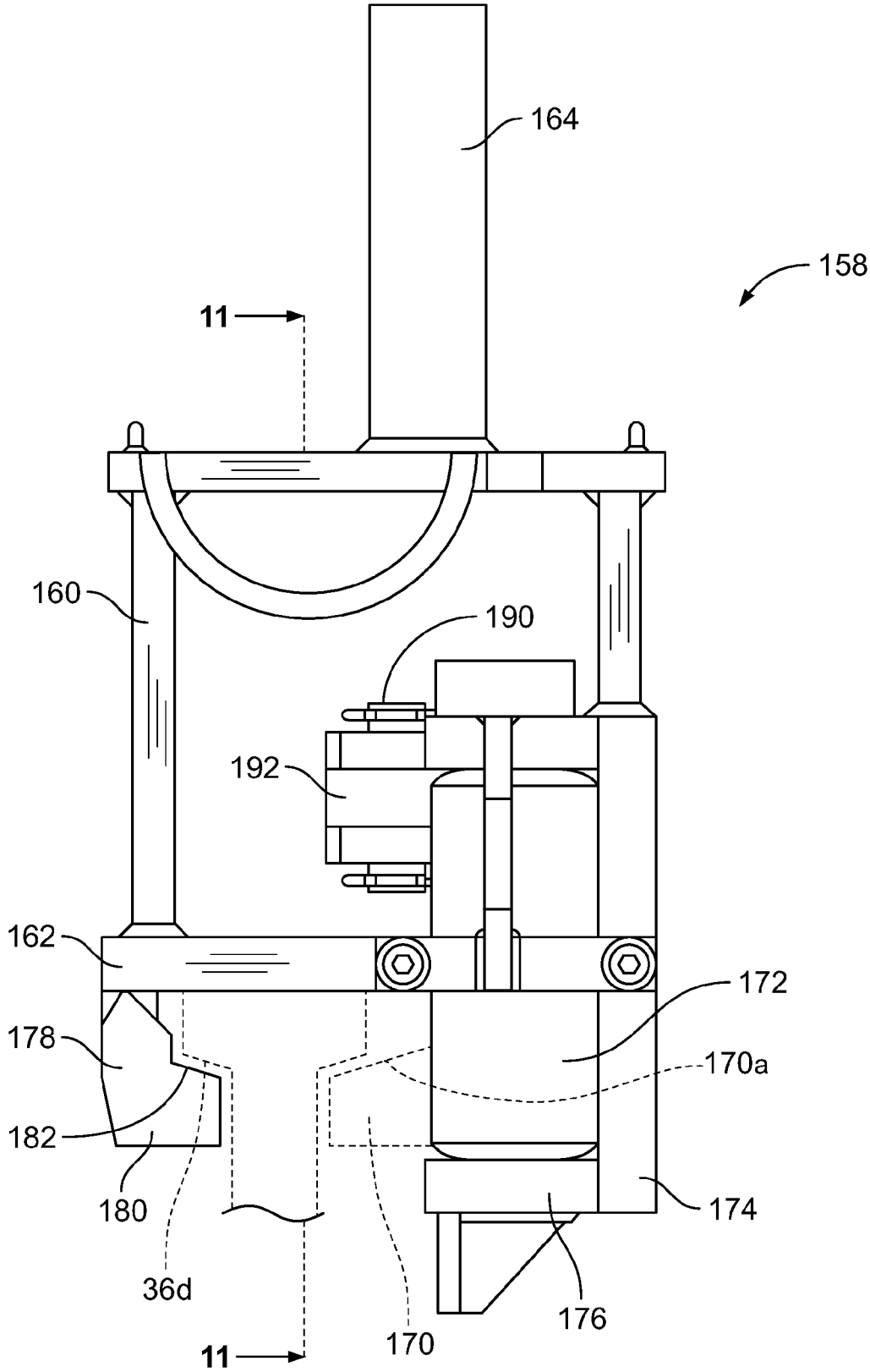
FIG. 10 is an end elevational view of the clamp device taken from the right end of FIG. 9, with the broken lines depicting a rail to which the clamp device is applied and showing the dog elements of the clamp device in their extended positions to clamp onto the rail.
Figure 11:
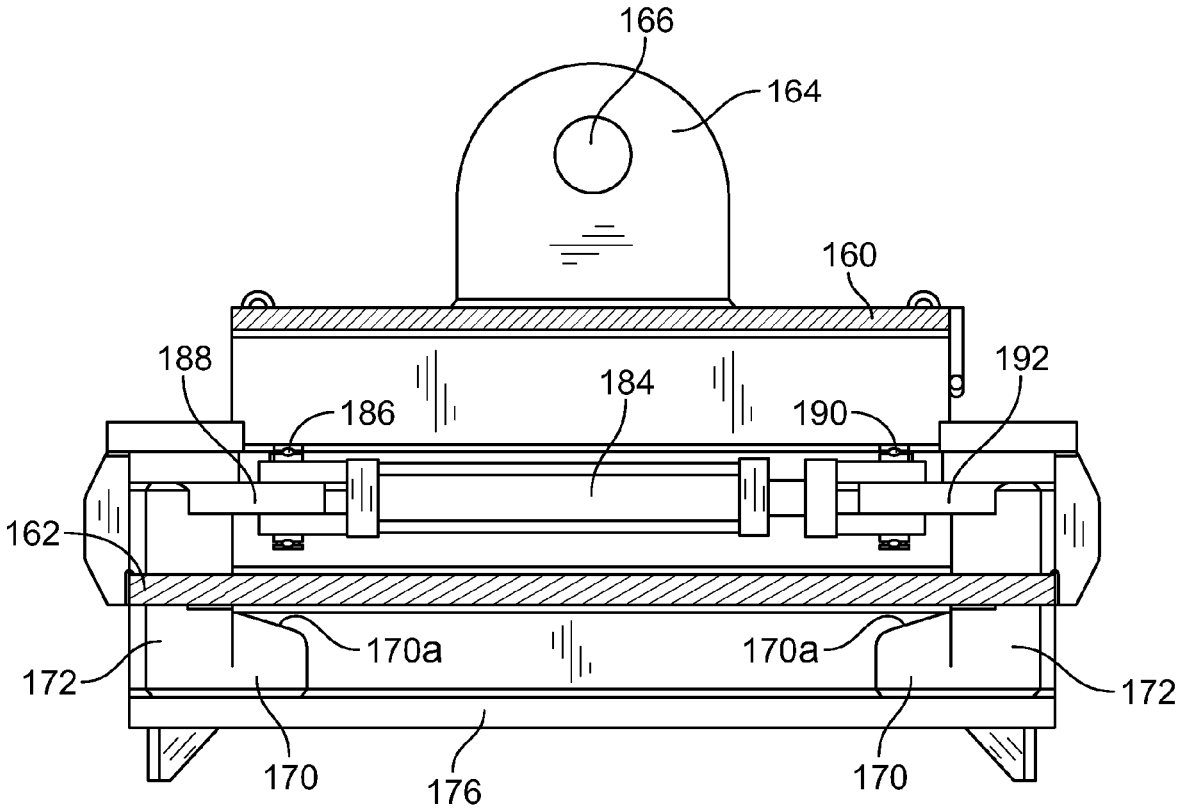
FIG. 11 is a fragmentary sectional view taken generally along line 11-11 of FIG. 10 in the direction of the arrows.

FIGS. 9-11 best illustrate the construction of the rail clamp 158. The rail clamp has a rigid frame 160 which takes the form of a box-type structure open at its opposite ends and having a flat base panel 162. Secured to the top of frame 160 is a lug 164 provided with an eye 166. The frame 160 may be suspended from the end of the boom 154 using a link 168 (see FIGS. 1 and 2) which is pivoted both to the end of the boom and to the eye 166 of the mounting lug 164.

As shown in FIGS. 9-11, the rail clamp 158 is provided with a pair of pivotal dog elements 170 which are carried on the lower ends of generally vertical posts 172. The posts 172 extend through panel 162 and carry the dog elements 170 on their lower ends at a location immediately below the panel 162. The posts 172 are mounted to turn about generally vertical axes located near opposite ends of the frame 160.

The dog elements 170 are adjacent to a side wall 174 of the frame 160 and immediately above a narrow shelf 176 secured to the lower end of wall 174 at one side of the frame 160. Extending downwardly from panel 162 on the side of frame 160 opposite wall 174 is an L-shaped rib 178 having an inwardly projecting lip 180 on its lower end. As best shown in FIG. 8, the upper surface of lip 180 is inclined at 182 to correspond with the inclination of the underside 36*d* of the rail flange 36*c*. A channel 183 (FIG. 9) is provided between the dog elements 170 and rib 178 for receiving the top portion of a rail 36 to which the rail clamp 158 is applied.

The dog elements 170 may be pivoted between a release position in which the dog elements are retracted to overlie the shelf 176 and a clamping position wherein the dog elements are pivoted toward the rib 178 as shown in broken lines in FIG. 8. Each of the dog elements 170 has an inclined upper surface 170*a* which serves as a wedge to securely clamp against the underside 36*d* of the rail flange 36*c* in the clamping position of the rail clamp 158.

Pivoting of the dog elements 170 is effected by a hydraulic cylinder 184. As best shown in FIG. 11, the base end of cylinder 174 is pivotally pinned at 186 to a lug 188 extending from the top portion of one of the posts 172. The opposite or rod end of cylinder 184 is pivotally pinned at 190 to a lug 192 extending from the other post 172. The cylinder 184 is located within the box structure provided by the clamp frame 160, and it is arranged such that when the piston rod of cylinder 184 is extended, the lugs 188 and 192 serve to crank posts 172 in opposite directions, thus pivoting the dog elements 170 in opposite pivotal directions toward the rib 178. When the rail clamp 158 is applied to a rail 36 in the release position of the clamp, the clamp is positioned such that the rail flange underside 36*d* fits on the inclined surface 182 of lip 180 as shown in FIG. 10. The cylinder 184 can then be extended to pivot the dog elements 170 in opposite pivotal direction such that the inclined surfaces 170*a* of the dog elements 170 act in wedging fashion against surface 36*d* to rigidly clamp the rail clamp 158 onto the rail and allow the boom to be manipulated in order to handle the rail 36.

The rail clamp 158 can be released from the rail by retracting the cylinder 184 to pivotally retract the dog elements 170 away from the rail, thereby releasing the clamp from the rail so that it can be removed.

As shown in FIGS. 1 and 2, the machine 10 may be equipped with a portable rail saw which is generally identified by numeral 194 and which may be applied to a rail 36 by a conventional crane generally identified by numeral 196.

The details of the construction of the rail saw 194 are best shown in FIGS. 12-15. The saw has a rigid rectangular frame 198 which includes four upright corner posts 200 connected at their lower ends on opposite sides of the frame by a pair of feet 202 which may take the form of tubes. The feet 202 rest on the bed of the vehicle frame 18 when the saw is not being used. The top ends of the posts 200 are connected by a pair of side members 204 on the opposite sides of the frame and by front and rear members 206 at the front and back of the frame. An adjustable intermediate cross member 208 is connected at its opposite end with a pair of sleeves 210 which fit on the top side members 204. The sleeves 210 may be adjusted along the lengths of the side members 204 and may be locked in position by tightening set screws 212.

An adjustable sleeve 214 fits on the intermediate cross member 208 and may be adjusted on it and locked in the desired position by tightening set screws 216. Extending upwardly from sleeve 214 is an ear 218 provided with an opening 220 for receiving tackle (not shown) used by the crane 196 to pick up, move and manipulate the saw 194.

Figure 14:
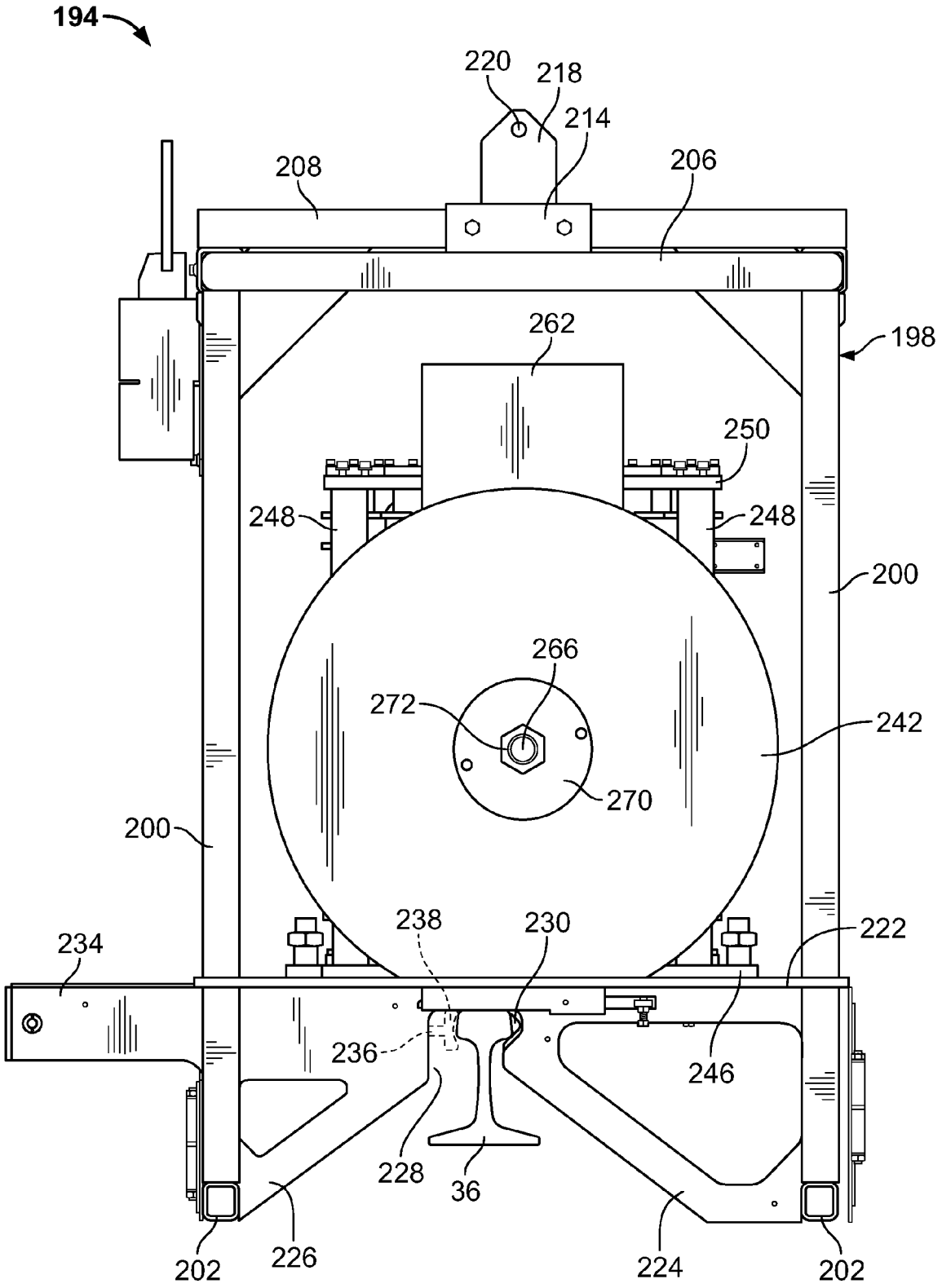
FIG. 14 is a front elevational view of the saw shown in FIG. 12.

The saw 194 has a horizontal platform 222 which is secured to the corner posts 200 at a location elevated above the feet 202. Immediately beneath the platform 222, a plurality of open gussets 224 are provided on one side of the saw frame. The gussets 224 are arranged in four sets, each including a pair of the gussets 224 spaced slightly apart from one another, with two pairs of the gussets 224 spaced relatively close together near the center of the platform 222 and the two other pairs of the gussets 224 located near the front and back portions of the saw frame. The opposite side of the frame is provided with a plurality of gusset plates 226 which are located immediately beneath the platform 228. The gusset plates 226 are arranged in four sets of pairs which oppose the gussets 224. As shown in FIG. 14, the opposing pairs of gussets 224 and 226 are spaced apart to provide a channel 228 in which the rail flange 36*c* is received when the saw 194 is applied to a rail 36. The edges of the gussets 224 adjacent to the rail 36 are provided with notches 230 in which the rail flange 36*c* is closely received when the saw is applied to rail 36.

Figure 12:
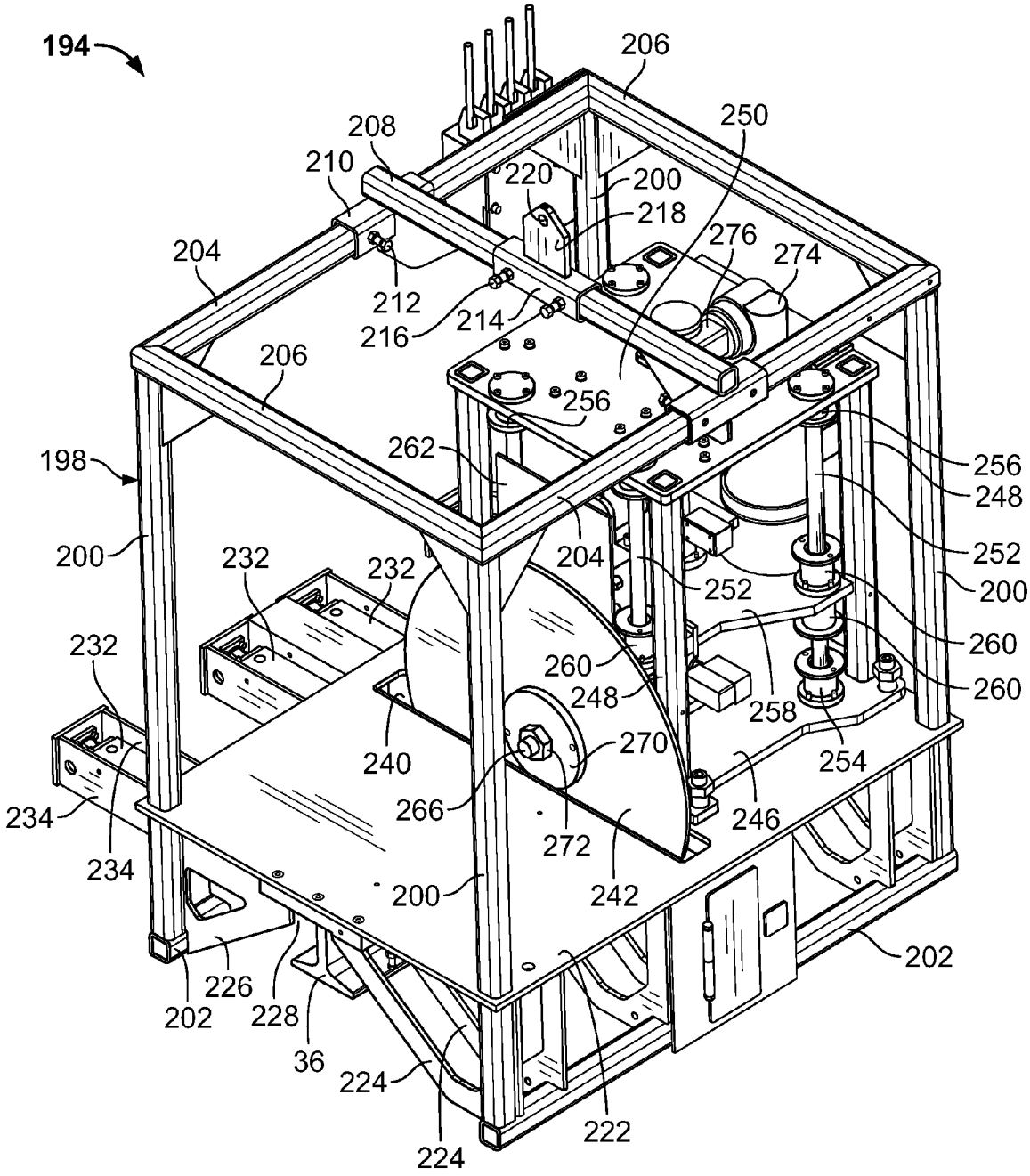
FIG. 12 is a perspective view of a portable saw that may be used with the machine shown in FIGS. 1 and 2, with the saw blade lowered to cut through a rail to which the saw is applied.

As best shown in FIG. 12, hydraulic cylinders 232 are mounted to the frame to operate in the space between each adjacent pair of the gusset plates 226. The bases of the cylinders 232 are located within open housings 234 secured to the side of frame 198 and essentially forming continuations of the gusset plates 226. As shown in FIG. 14, each cylinder 232 has a piston rod 236 which carries a clamp 238 on its end. When the cylinders 232 are extended, the clamps 238 act in opposition to the notches 230 to securely clamp onto the rail flange 36*c* and thereby rigidly clamp the saw 194 onto rail 36.

As best shown in FIG. 12, a pair of the cylinders 232 are located close to and on opposite sides of a slot 240 which is formed in platform 222 to extend sidewardly near the center of the platform. The slot 240 accommodates a circular saw blade 242 which extends through the slot when the saw is operating to cut through a rail 36. Consequently, two of the cylinders 232 clamp the rail 36 securely on opposite sides of the slot 240 and very near the slot to provide particular stability for the cut. The other two cylinders 232 are located adjacent to the opposite ends of the saw and provide additional clamping force of the saw on the rail at these locations.

Figure 13:
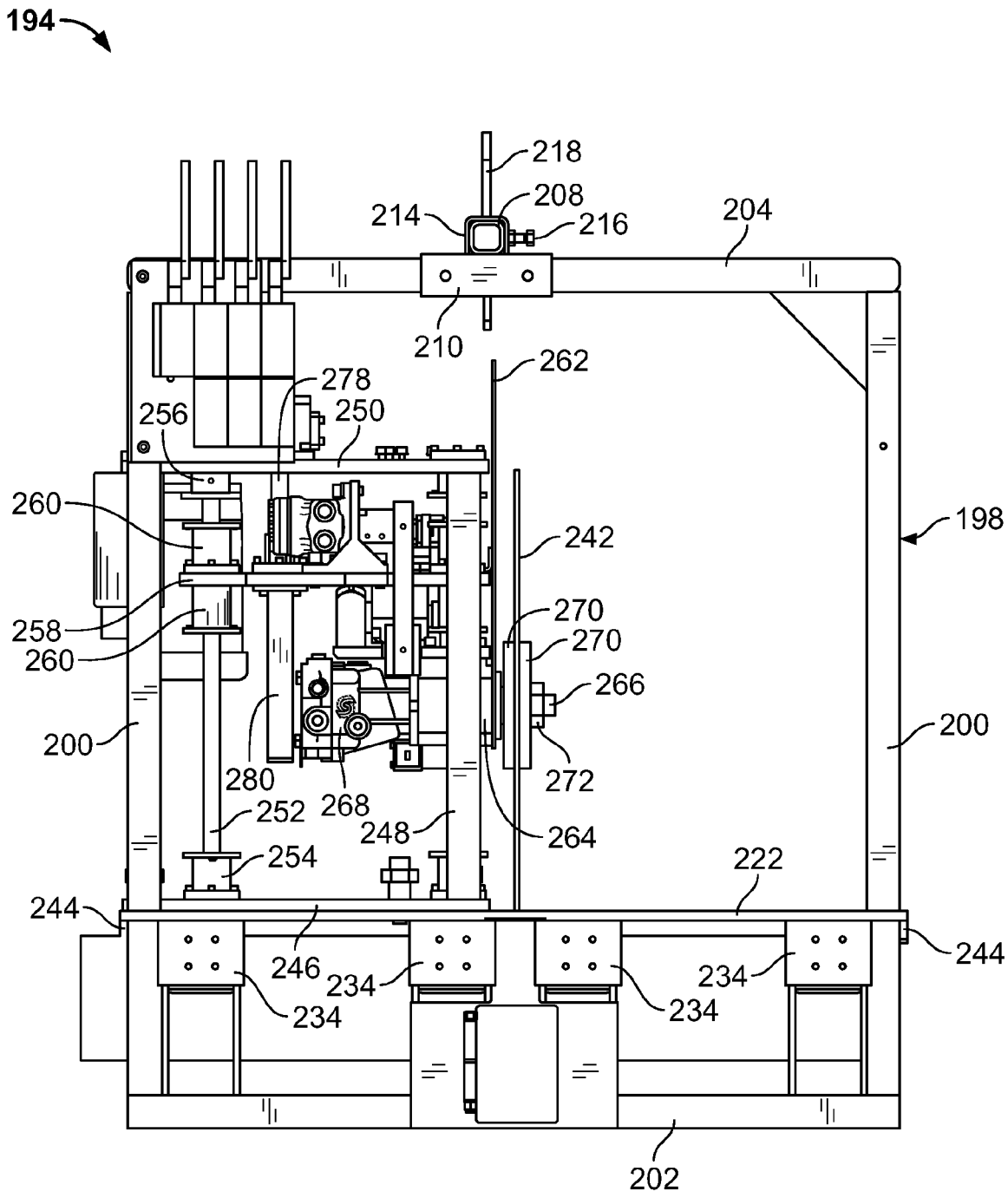
FIG. 13 is a side elevational view of the saw shown in FIG. 12, with the blade in its raised position.
Figure 15:
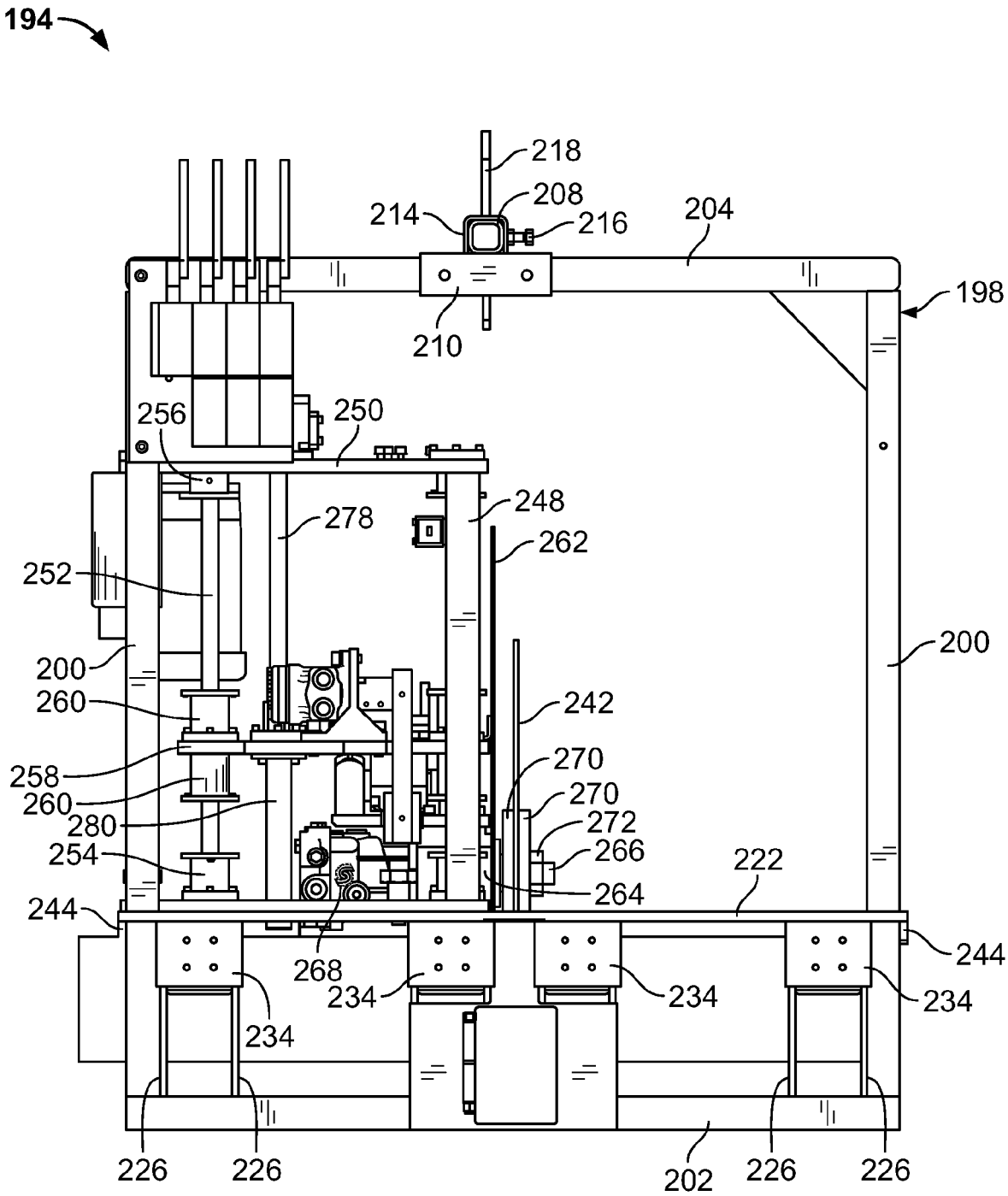
FIG. 15 is a side elevational view similar to FIG. 13, but showing the blade lowered to cut through a rail to which the saw is applied.

As shown in FIGS. 13 and 15, the opposite ends of the frame 198 are provided with limit switches 244 which are tripped by the rail 36 when the saw frame 198 is applied to the rail in a level position. The purpose for the switches 244 is to assure that the saw frame is applied to the rail such that the plane of the saw blade 242 is precisely perpendicular to the longitudinal axis of the rail 36 so that the cut made by the blade 242 is perpendicular to the rail axis. Both of the limit switches 244 are tripped only if the saw frame is applied with the plane of blade 242 perpendicular to the rail axis, and the cylinders 232 are disabled unless both of the limit switches are tripped, thus assuring that the saw can be clamped onto rail 36 only with the plane of blade 242 precisely perpendicular to the axis of the rail.

A frame for supporting the saw blade 242 includes a base plate 246 mounted on platform 222 and having four upright posts 248 supporting a top plate 250 on their upper ends. A plurality of vertical guide rods 252 extend through sleeves 254 and 256 connected with the respective bottom and top plates 246 and 250. A horizontal mounting plate 258 is sandwiched between and connected with pairs of guide sleeves 260 which fit slidably on the guide posts 252. In this manner, the mounting plate 258 is supported to move up and down on the guide posts 252, and the saw blade 242 is mounted to move linearly up and down along a cutting path that carries the blade through channel 228 to effect a cut through a rail 36 held in the channel.

A vertical bracket plate 262 is secured to the front edge of the mounting plate 258. As best shown in FIGS. 13 and 15, the bracket plate 262 carries a bearing 264 which in turn rotatively supports a horizontal drive shaft 266. A hydraulic motor 268 operates the drive shaft 266. The saw blade 242 is mounted on the shaft 266, preferably by sandwiching the blade between a pair of flanges 270 and securing the blade assembly with a nut 272 threaded onto the end of shaft 266.

The up and down strokes of the saw blade 242 are effected by a reversible electric motor 274 (FIG. 12) mounted on the top plate 250. A worm drive 276 is operated by the motor 274 and rotates a vertical worm shaft 278 (FIGS. 13 and 15). The worn shaft 276 is threaded into a tube 280 secured to the underside of plate 258, thus driving plate 258 and the saw blade 242 down and up when the electric motor 274 is activated in the forward and reverse operating modes.

Figure 16:
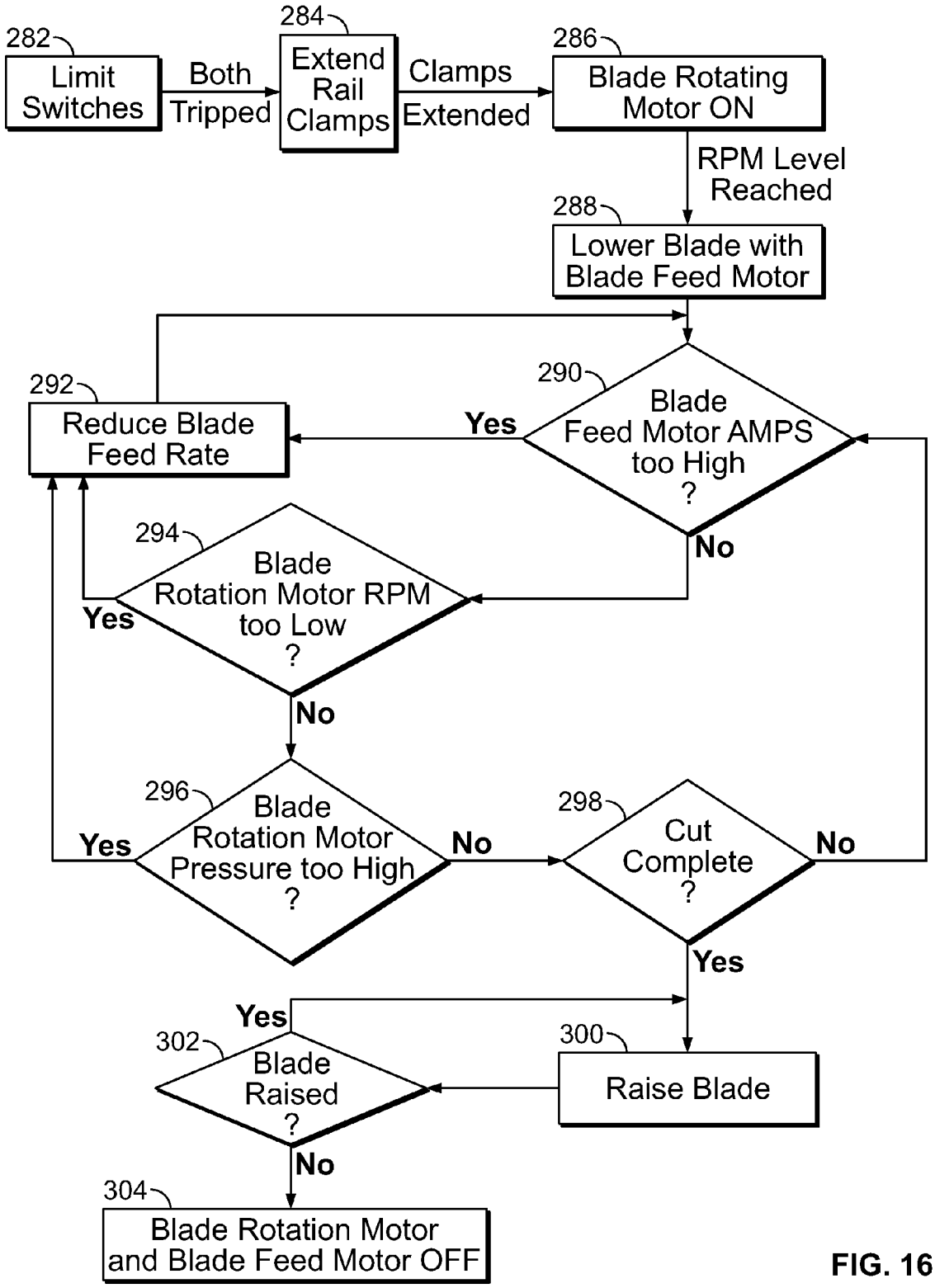
FIG. 16 is a flow diagram for the control system used to control operation of the saw shown in FIGS. 12-15.

FIG. 16 is a flow diagram for the control system which controls operation of the saw 194. When the saw frame is applied to a rail which is to be cut, a determination is made in block 282 as to whether both limit switches 244 are tripped. If both of the switches 282 are tripped, the cylinders 232 are extended as indicated in block 284. When the cylinders are fully extended to fully extend the clamps 238 in order to securely grip onto the rail 36, the hydraulic blade rotation motor 268 is activated, as indicated at block 286. When the blade 242 has reached the desired RPM level as detected by a suitable sensor, the electric motor 274 is activated by a control as indicated in block 288 to lower the blade 242 and initiate a cut through the rail 36.

The current drawn by the electric blade feed motor 274 is monitored in block 290 by a sensor to determine if the current is high enough to indicate undue resistance to the cut. If the current is excessive, a suitable control reduces the blade feed rate such that the blade is lowered more slowly, as indicated at block 292. If the current is not excessive, a determination is made by a sensor (block 294) as to whether the RPM level of the hydraulic blade rotation motor 268 is too low, again indicating excessive resistance to the cut. If the blade is rotating too slowly, the blade feed rate is reduced by reducing the speed of the blade feed motor 274 using a suitable control. If the blade is rotating at an adequate speed, a determination is made by another sensor (block 296) as to whether the hydraulic pressure for the blade rotation motor 268 is excessive, thus indicating undue resistance to the cut. If the pressure is excessive, the feed rate of the blade is reduced by a control as indicated at block 292. After the blade feed rate has been reduced in block 292 for any reason, the blade feed motor current is monitored again at block 290, and the blade rotation speed and pressure are successively monitored at blocks 294 and 296 to assure that the cut proceeds at a rate slow enough to avoid undue resistance that could cause binding or other problems.

If a determination is made in block 296 that the blade rotation motor pressure is acceptable, a determination is made in block 298 by a sensor as to whether the cut has been completed, that is whether the blade 242 has reached the downward end of its feed stroke and cut completely through the rail 36. If the cut is not complete, the program returns to block 290. Once the cut has been completed, a control causes the blade to be raised while it continues to rotate, as indicated at block 300. A determination is made by a sensor (block 302) as to whether the blade has been fully raised to the upper limit of its up/down stroke. If it has not, raising of the blade continues via block 300 with the blade continuing to rotate under power. When the blade has been fully raised, the blade rotation motor 268 is deactivated by a control along with the blade feed motor 274, as indicated at block 304.

In operation, the vehicle 12 may be driven either along a roadway such as roadway 24 (FIG. 2) or along railroad tracks such as the rails 30 (FIG. 1) to a site at which rails 36 are to be unloaded from the rail carrying car 38. If the vehicle is driven over the road, the railway wheels 26 are raised as shown in FIG. 2 so that the vehicle can make use of the tires 22 for over-the-road travel along the roadway 24. Once the site of the rail unloading operation has been reached, the vehicle is positioned on the rails 30, and the cylinders 34 are then extended to lower the railway wheels 26 onto the rails 30 and raise the tires 22 off of the railway bed so that the railway wheels 26 can be used for transporting the vehicle along the rails 30.

When the machine 10 is transported over the road, the threading mechanisms 46, 48 and 50 are all in their retracted and raised positions to provide a sufficiently narrow profile that the vehicle can travel safely over standard width highways and other roadways. The thread boxes 64, 90 and 118 can all be rotated on the ends of the arm assembly to enhance the narrow profile of the vehicle in the transport position. Raising the threading mechanisms well above the roadway 24 enhances the narrow profile of the machinery and also provides a stable and safe raised position for the thread boxes during transport.

For transport, the crane 146 is preferably folded up as shown in FIG. 2 to provide a compact configuration. The telescoping boom sections 156 are fully retracted within one another and within the base boom section 152, and the arm 150 and boom section 152 are folded in the manner shown in FIG. 2 (such as through the use of hydraulic cylinders).

When the vehicle 12 has reached the site at which rails are to be unloaded, it is positioned on the railway 30, and cylinders 34 are then extended to lower the railway wheels 26 onto the rails 30 and to raise the tires 22 off of the railway bed so that the vehicle 10 move along the rails 30 using the railway wheels 26. The machine 10 may be hitched to the rail carrying car 38 (or to a number of rail carrying cars connected end to end).

The crane 146 and boom 154 are unfolded and extended in the manner shown in FIG. 1, and the crane is then used to apply the rail clamp 158 to one of the rails 36 held on the rail bunk 40. The clamp 158 is applied to the rail 36 in the manner shown in FIG. 10, and the cylinder 184 is then extended to pivot the dog elements 170 in opposite directions to cause the clamp 158 to rigidly clamp onto rail 36 as shown in broken lines in FIG. 10. The inclined surfaces 170*a* of dog elements 170 act as wedges to apply increasing pressure against the rail flange underside 36*d* with progressive pivotal movement of the dog elements toward the clamping position. By arranging the dog elements 170 to pivot in opposite directions as they clamp onto the rail 36, the crane 146 is able to manipulate rail 36 using the clamp in directions both toward and away from the cab 14 as is sometimes necessary in order to apply the rail to the threading mechanisms. Because the dog elements 170 pivot against the rail in opposite directions, assurance is provided that the clamp will not slip on the rail whichever direction the rail is manipulated by the crane and clamp.

Each rail 36 is initially applied to the threading mechanisms 46, 48 and 50 with the threading mechanisms in their fully extended operating positions and the jaws 130 in the fully open position shown in FIG. 7. Because ample space is provided to apply rail 36 to the thread boxes when the jaws are open, the rails can easily be applied on top of the support rollers 128 of each thread box without the need to be particularly precise in the placement of the rail. Once the rail 36 is in place on the support rollers 128, cylinders 138 are extended to close the jaws to the position shown in FIG. 8, with the rollers 140 fitting closely against the edges of the rail base 36*a*, rollers 142 fitting closely against the top surface of the rail flange 36*c*, and rollers 144 fitting closely against the side edges of the rail flange 36*c*. When the jaws are fully closed as shown in FIG. 8, rail 36 is closely embraced by the rollers and properly positioned to allow the threading mechanisms to thread the rail forwardly and out of the rail bunk 40 onto the railway bed.

The rail car vehicle 12 is moved along the rails 30 in a direction opposite the direction the rails 36 are threaded through the threading mechanisms 46, 48 and 50. To assure effective unloading of the rails 36 without either unduly dragging them along the railway bed or driving them into the bed, the vehicle 12 should have the same linear speed along rails 30 as the linear speed the rails 36 are advanced by the threading mechanisms.

Figure 17:
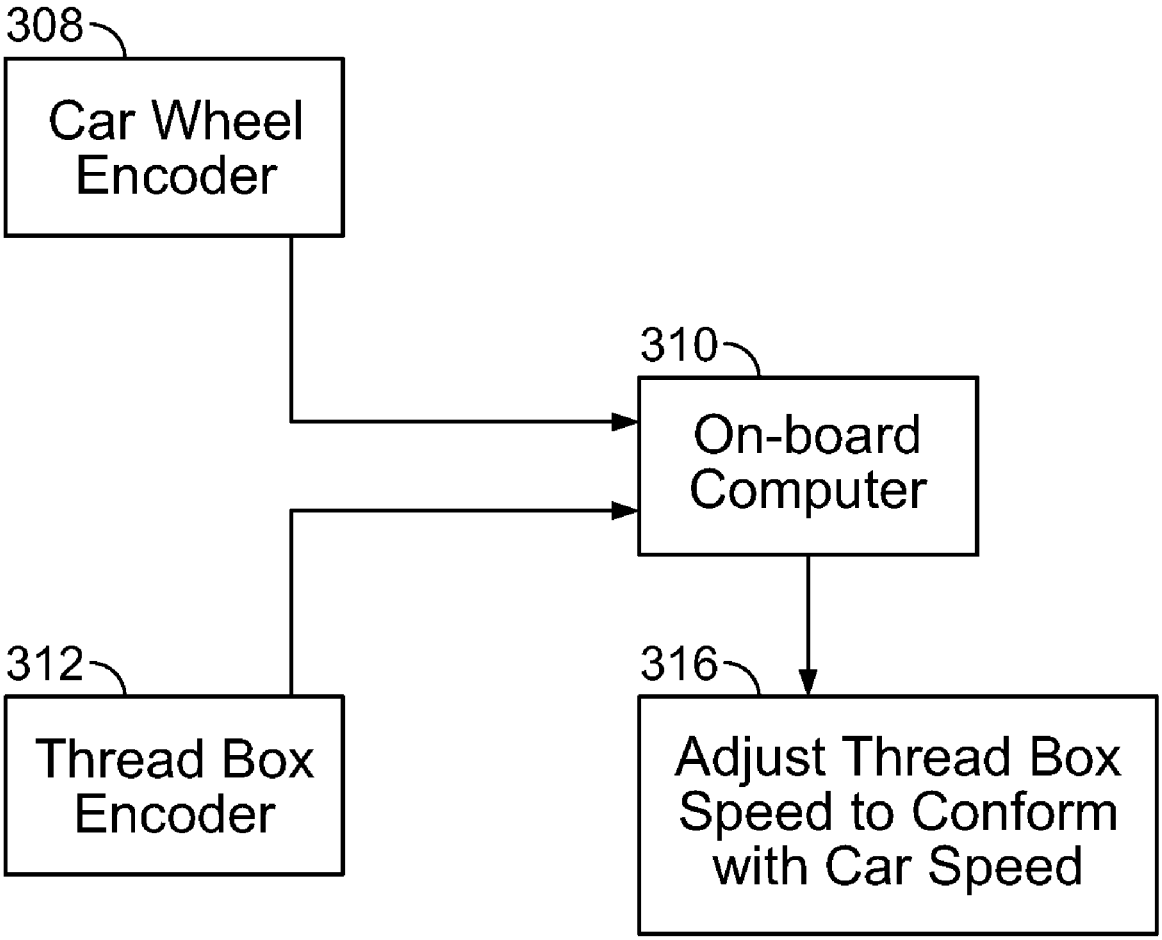
FIG. 17 is a block diagram of the control system that maintains conformity of the rail unloading speed with the vehicle speed.

To this end, one or more of the railway wheels 26 is equipped with a wheel encoder 306 (FIG. 1) which senses the rotational speed of the wheel 26 and translates the rotational speed of the wheel into the linear speed of the vehicle 12. With reference to FIG. 17, the wheel encoder data in block 308 is input to an on-board computer 310 located on the vehicle 12. Another input to computer 310 is provided from block 312 which supplies the computer with information from an encoder 314 (FIG. 8). Encoder 314 may measure the rotational speed of roller 140 or another thread box roller to provide a measurement of the linear speed at which the rail 36 is being threaded through thread box 118 (or another thread box). As indicated at block 316 in FIG. 17, the computer compares the speed data received from blocks 308 and 312 and adjusts the thread box speed to achieve conformity between the vehicle speed and the linear speed at which the rails 36 are fed from the vehicle. In this way, the speed at which rails are unloaded is matched to the vehicle speed.

The rails are preferably applied in pairs to the threading mechanisms on the opposite sides of the vehicle 10 so that the rails are unloaded in pairs on opposite sides of the rails 30 outwardly of the railway ties 32. As is evident from FIGS. 6, 4 and 3, the rails that are being handled by the machine are progressively farther apart from the rear threading mechanisms to the front threading mechanisms to assure proper placement of the rails unloaded onto the railway bed.

The mounting of each of the thread boxes 64, 90 and 118 to pivot on the ends of the arm assemblies, as exemplified by the pivot axis 122 shown in FIG. 6 for the rear thread boxes 118, allows the thread boxes to pivot sufficiently to accommodate threading of the rails 36. Similarly, mounting of each thread box 64, 90 and 118 to rotate on a turntable, as exemplified by the turntable 120 shown in FIGS. 5-6 for the rear thread boxes 118, allows each thread box to turn to an appropriate angle to receive a rail 36 as shown for the lowermost thread box 90 in FIG. 4. This rotation of the thread boxes also allows them to be rotated for storage to an angle where their extension to the side is minimized so that a narrow profile for transport is obtained, as shown for thread boxes 90 in FIG. 5.

When road crossings, bridges or other structures are encountered along a railway, it is sometimes necessary to cut the rails in order to accommodate the road crossing or bridge. If cutting of the rails is necessary, the saw 194 can be picked up by the crane 196 and placed on top of a rail held in extension through the threading mechanisms at the location on the rail where the cut is desired. When the saw has been placed properly in a level position on the rail 36, both of the limit switches 244 are tripped, and the cylinders 232 are then extended to extend the clamps 238 and thereby clamp the saw rigidly in a level position on top of the rail, as shown in broken lines in FIG. 14. Once the clamps 232 have been fully extended, the hydraulic blade rotation motor 268 is activated until the saw blade 242 is rotated at the desired design speed. Then, the electric blade feed motor 274 is activated in a mode to effect a downward cutting stroke of the blade 242 to initiate the cut through rail 36.

With reference to FIG. 16, the blade feed motor amperage is monitored at block 290, the blade rotation motor speed is monitored at block 294, and the blade rotation motor pressure is monitored at block 296. If any of these monitored variables are sensed as being improper, indicating undue resistance to the cut, the blade feed rate is reduced as indicated at block 292 until acceptable levels of all of the variables are present.

When the lower limit of the blade cutting stroke has been reached indicating that the cut is complete, the blade is raised upwardly through the cut with the blade still rotating at its design speed to facilitate the return stroke to the upper limit of the blade travel. Only after the blade has reached the upper limit of its stroke is the blade rotation motor deactivated along with the blade feed motor, as indicated in block 304.

It is thus evident that the rails can be unloaded in a fully automated manner without the need for workers to be in the immediate vicinity of the rails or the machine that handles them, and this reduces the risk of personal injury to railway maintenance personnel. The saw 194 can also be operated without the need for personnel in its immediate vicinity. As can be easily appreciated, cutting through a large steel rail creates high heat, sparks and other sources of potential injury during operation of the heavy duty cutting equipment, so it is highly desirable for workers to be able to move away from the site of the cutting as is allowed by the saw of the present invention.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A thread box for gripping and guiding a rail having a base with opposed edges and a flat bottom, a vertical web extending upward from said base, and a top flange formed at a top of the web opposite the base, the top flange having opposed edge surfaces and a top surface, said thread box comprising:

a) a platform for supporting the fiat bottom of a rail; and b) a pair of opposed jaws, each said jaw hingedly connected to said platform by a respective pivot joint, said jaws moveable between a closed position wherein said frame and jaws define a passage above said platform substantially closed at the top, bottom and sides, and an open position wherein said passage is open at the top to accommodate feeding of a rail onto said platform; and c) at least one support roller on said platform for rollingly engaging the flat bottom of a rail positioned in said passage.

2. The thread box as in claim 1 wherein each said jaw includes a respective frame and a respective jaw roller rotatably mounted to said frame, said jaw roller positioned for rollingly engaging a rail positioned in said passage when the respective jaw is in the closed position.

3. The thread box as in claim 2 wherein said jaw roller is a base roller positioned for engaging an edge of the base of a rail positioned in said passage.

4. The thread box as in claim 2 wherein said jaw roller is a flange top roller positioned for engaging a top surface of the top flange of a rail positioned in said passage.

5. The thread box as in claim 2 wherein said jaw roller is a flange side roller positioned for engaging an edge surface of the top flange of a rail positioned in said passage.

6. The thread box as in claim 1 and further including a pair of linear actuators, each said actuator being connected between said platform and a respective one of said jaws for moving said respective jaw between said open and closed positions.

7. A rail threading mechanism comprising the thread box as in claim 1 in combination with an arm assembly, wherein said thread box is mounted on an outer end of said arm assembly.

8. The rail threading mechanism as in claim 7 wherein said thread box is connected to said arm assembly by a turntable, said turntable allowing rotation of said thread box relative to said arm assembly.

9. The rail threading mechanism as in claim 7 wherein said arm assembly includes an outer arm pivotally connected to an inner arm and wherein said thread box is mounted on said outer arm.

10. A thread box for gripping and guiding a rail having a base with opposed edges and a flat bottom, a vertical web extending upward from said base, and a top flange formed at a top of the web opposite the base, the top flange having opposed edge surfaces and a top surface, said thread box comprising:

a) a platform including at least one support roller for rollingly engaging the flat bottom of a rail; and b) a pair of opposed jaws pivotally connected to said platform and moveable between a closed position wherein said frame and jaws define a passage above said platform substantially closed at the top, bottom and sides, and an open position wherein said passage is open at the top to accommodate feeding of a rail onto said support roller, each said jaw including:

i) a frame;

ii) at least one base roller positioned for engaging an edge of the base of a rail positioned in said passage;

iii) at least one flange top roller positioned for engaging a top surface of the top flange of a rail positioned in said passage; and iv) at least one flange side roller positioned for engaging an edge surface of the top flange of a rail positioned in said passage.

11. The thread box as in claim 10 and further including a pair of linear actuators, each said actuator being connected between said platform and a respective one of said jaws for moving said respective jaw between said open and closed positions.

12. A rail threading mechanism comprising the thread box as in claim 10 in combination with an arm assembly, wherein said thread box is mounted on an outer end of said arm assembly.

13. The rail threading mechanism as in claim 12 wherein said thread box is connected to said atm assembly by a turntable, said turntable allowing rotation of said thread box relative to said arm assembly.

14. The rail threading mechanism as in claim 12 wherein said arm assembly includes an outer arm pivotally connected to an inner arm.

15. In combination with a vehicle for handling railroad rails, a rail threading mechanism for gripping and guiding a rail having a base with opposed edges and a flat bottom, a vertical web extending upward from said base, and a top flange formed at a top of the web opposite the base, the top flange having opposed edge surfaces and a top surface, said rail threading mechanism comprising:

a) an arm having an inner end connected to the vehicle and an outer end; and b) a thread box mounted on said arm proximate said outer end thereof, said thread box including:

i) a platform including at least one support roller for rollingly engaging the flat bottom of a rail; and ii) a pair of opposed jaws, each said jaw hingedly connected to said by a respective pivot joint, said jaws moveable between a closed position wherein said frame and jaw present a passage above said support roller substantially closed at the top, bottom and sides, and an open position wherein said passage is open at the top to accommodate feeding of rails onto said support roller; each said jaw including a respective frame and a respective plurality of jaw rollers rotatably mounted to said frame, said jaw rollers positioned for rollingly engaging a rail positioned in said passage when the respective jaw is in the closed position.

16. The rail threading mechanism as in claim 15 wherein said plurality of jaw rollers on each said jaw includes at least one base roller positioned for engaging an edge of the base of a rail positioned in said passage.

17. The rail threading mechanism as in claim 15 wherein said plurality of jaw rollers on each said jaw includes at least one flange top roller positioned for engaging a top surface of the top flange of a rail positioned in said passage.

18. The rail threading mechanism as in claim 15 wherein said plurality of jaw rollers on each said jaw includes at least one flange side roller positioned for engaging an edge surface of the top flange of a rail positioned in said passage.

19. The rail threading mechanism as in claim 15 wherein said thread box further includes a pair of linear actuators, each said actuator being connected between said platform and a respective one of said jaws for moving said respective jaw between said open and closed positions.

20. The rail threading mechanism as in claim 15 wherein said thread box is connected to said arm assembly by a turntable, said turntable allowing rotation of said thread box relative to said arm assembly.

21. The rail threading mechanism as in claim 15 wherein said arm assembly includes an outer arm pivotally connected to an inner arm.

22. A thread box for gripping and guiding a rail having a base with opposed edges and a flat bottom, a vertical web extending upward from said base, and a top flange formed at a top of the web opposite the base, the top flange having opposed edge surfaces and a top surface, said thread box comprising:

a) a platform for supporting the flat bottom of a rail; and b) a pair of opposed jaws, each said jaw hingedly connected to said platform by a respective pivot joint, said jaws moveable between a closed position wherein said frame and jaws define a passage above said platform substantially closed at the top, bottom and sides, and an open position wherein said passage is open at the top to accommodate feeding of a rail onto said platform; wherein c) each said jaw includes a respective frame and a respective jaw roller rotatably mounted to said frame, said jaw roller positioned for rollingly engaging a rail positioned in said passage when the respective jaw is in the closed position.

23. The thread box as in claim 22 and further including at least one support roller on said platform for rollingly engaging the flat bottom of a rail positioned in said passage.

24. The thread box as in claim 22 wherein said jaw roller is a base roller positioned for engaging an edge of the base of a rail positioned in said passage.

25. The thread box as in claim 22 wherein said jaw roller is a flange top roller positioned for engaging a top surface of the top flange of a rail positioned in said passage.

26. The thread box as in claim 22 wherein said jaw roller is a flange side roller positioned for engaging an edge surface of the top flange of a rail positioned in said passage.

27. The thread box as in claim 22 and further including a pair of linear actuators, each said actuator being connected between said platform and a respective one of said jaws for moving said respective jaw between said open and closed positions.

28. A rail threading mechanism comprising the thread box as in claim 22 in combination with an arm assembly, wherein said thread box is mounted on an outer end of said atm assembly.

29. The rail threading mechanism as in claim 28 wherein said thread box is connected to said arm assembly by a turntable, said turntable allowing rotation of said thread box relative to said arm assembly.

30. The rail threading mechanism as in claim 28 wherein said arm assembly includes an outer arm pivotally connected to an inner arm and wherein said thread box is mounted on said outer arm.

* * * * *